United States Patent [19]

Aoyama

[11] 4,324,210

[45] Apr. 13, 1982

[54] HYDRAULIC VALVE LIFTER AND FLUID PRESSURE CONTROL DEVICE THEREFOR

[75] Inventor: Syunichi Aoyama, Yokohama, Japan

[73] Assignee: Nissan Motor Company, Limited, Yokohama, Japan

[21] Appl. No.: 55,757

[22] Filed: Jul. 9, 1979

[30] Foreign Application Priority Data

Jul. 19, 1978 [JP] Japan ..... 53-88141
Feb. 20, 1979 [JP] Japan ..... 54-21493[U]

[51] Int. Cl.[3] ..... F01L 1/14

[52] U.S. Cl. ..... 123/90.55; 123/90.12; 123/90.16

[58] Field of Search ..... 123/90.12, 90.15, 90.16, 123/90.46, 90.48, 90.52, 90.55, 90.56, 90.57

[56] References Cited

U.S. PATENT DOCUMENTS

| | | | |
|---|---|---|---|
| 2,688,318 | 9/1954 | Voorhies et al. | 123/90.55 |
| 2,966,151 | 12/1960 | Wood | 123/90.55 |
| 3,490,423 | 1/1970 | Shunta et al. | 123/90.55 |
| 4,111,165 | 9/1978 | Aoyama et al. | 123/90.15 |
| 4,150,640 | 4/1979 | Egan | 123/90.15 |
| 4,206,728 | 6/1980 | Trenne | 123/90.12 |

FOREIGN PATENT DOCUMENTS

| | | | |
|---|---|---|---|
| 2051220 | 4/1972 | Fed. Rep. of Germany | 123/90.12 |

*Primary Examiner*—Craig R. Feinberg
*Assistant Examiner*—W. Wolfe
*Attorney, Agent, or Firm*—Schwartz, Jeffery, Schwaab, Mack, Blumenthal & Koch

[57] ABSTRACT

A valve lift control apparatus for an internal combustion engine, characterized by a hydraulic valve lifter constructed and arranged so that the motion of the cam for driving the intake or exhaust valve in each power cylinder is transmitted through the valve lifter to the valve without intervention of any axially abutting engagement between the movable members of the valve lifter by the fluid pressures intervening between the individual movable members. The valve lift control apparatus may further comprise a fluid pressure control device for varying the fluid pressure to be supplied to a hydraulic valve lifter in relation to certain operational conditions of the engine.

29 Claims, 11 Drawing Figures

HYDRAULIC VALVE LIFTER AND FLUID PRESSURE CONTROL DEVICE THEREFOR

FIELD OF THE INVENTION

The present invention relates to a valve lift control apparatus for an internal combustion engine and, particularly, to a valve lift control apparatus including a hydraulically operated valve lifter and preferably a fluid pressure control device for controlling the fluid pressure to be supplied to the hydraulic valve lifter.

BACKGROUND OF THE INVENTION

As is well known in the art, the motions of the intake and exhaust valves of an internal combustion engine are timed by the contours of the cams on the camshaft of the engine for opening and closing the intake and exhaust ports of the individual power cylinders of the engine at proper timings to achieve best possible engine performances, particularly, the best volumetric efficiency of the engine. The intake and exhaust valves actuated at the timings thus controlled are concurrently open at least in part at the end of each exhaust stroke and at the beginning of each intake stroke of each of the power cylinders and gives a valve overlap period across the top dead center (TDC) in each cycle of operation of the power cylinder. The valve timings are usually determined with a view to producing maximum intake and exhaust efficiencies and accordingly sufficient amounts of valve overlap when the engine is operating under full power conditions. Under low-to-medium power operating conditions such as, for example, idling conditions of the engine, however, such a valve overlap is excessive for the velocity of the piston movement and, as a consequence, the fresh fuel-air mixture supplied to the combustion chamber of each the power cylinders of the engine tends to blow by into the exhaust port of the cylinder or the exhaust gases to be discharged from the combustion chamber tend to be partially admixed to the fresh fuel-air mixture entering the combustion chamber. This is not only detrimental to the fuel economy of the engine but causes incomplete combustion of the mixture in the combustion chamber and thus gives rise to an increase in the concentration of the toxic unburned compounds in the exhaust gases produced in the engine.

On the other hand, there is an internal combustion engine in which the intake valve is so timed as to remain open until the crankshaft rotation angle of 50 to 60 degrees after the bottom dead center (BDC) on the compression stroke in an attempt to effect inertia supercharging under high speed, full power operating conditions of the engine when increased charging efficiencies are required. In an internal combustion engine of this nature, a problem arises in that the fuel-air mixture which has once been admitted into the combustion chamber is caused to flow backwardly into the intake port under low speed operating conditions of the engine.

With a view to eliminating these problems encountered by valve lifters of the solid type, a hydraulically operated valve lifter has been proposed and put into practice which is capable of continuously varying the opening and closing timings of the intake or exhaust valve in proper relationship to the operating conditions, especially the power output, of an internal combustion engine.

An object of the present invention is to provide a valve lift control apparatus specifically characterized by a hydraulic valve lifter by means of which the opening and closing timings of the intake or exhaust valve to be actuated by the valve lifter and the amount of lift of the valve and accordingly the amount of overlap between the intake and exhaust valves of a power cylinder can be properly varied with the fluid pressure supplied to the valve lifter and accordingly with the varying operating conditions of the engine.

It is another object of the present invention to provide a hydraulic valve lifter characterized in that the movement of the cam for driving the valve lifter is transmitted to the intake or exhaust valve without intervention of any abutting or striking engagement between the movable members included in the valve lifter. More specifically, the driving force imparted to the valve lifter from the cam driven by the engine crankshaft is transmitted through the valve lifter to the push-rod or directly to the rocker arm for the intake or exhaust valve solely by fluid pressures intervening between the individual movable members of the valve lifter so that substantially no mechanical impact occurs in the valve lifter.

The fluid used as the hydraulic pressure medium in a hydraulic valve lifter is, typically, the lubricating oil for the engine. When the engine is being cranked cold during starting or being warmed up after starting, the engine lubricating oil is maintained at low temperatures and tends to be excessively pressurized because of the low fluidity of the oil having a high viscosity at a low temperature. During idling conditions of an internal combustion engine, for example, the pressure of the oil delivered from the engine oil pump increases to the order of 2 to 3 kgs/cm$^2$ as compared with the pressure of about 1 kg/cm$^2$ or lower at normal temperatures of the oil. If the oil delivered from an engine oil pump is used for operating a hydraulic valve lifter, therefore, it will happen that the valve timings under cold starting or warming-up conditions of the engine are such that are proper for medium-to-high power conditions of the engine so that the amounts of valve overlap resulting from the valve timings are excessive for, for example, idling conditions of the engine. Furthermore, the high viscosity of the engine oil supplied to the valve lifter impairs the mobility of the movable members in the valve lifter, which therefore behaves as if the same is supplied with a higher fluid pressure than the oil pressure actually supplied thereto. This will cause improper retardation of the valve closing timings and lead to deterioration of the performance efficiency of the engine.

Thus, the present invention further has an object in providing a valve lift control apparatus comprising, in combination with a hydraulic valve lifter a fluid pressure control valve adapted to reduce the fluid pressure to be the valve lifter under predetermined conditions such as cold starting or warming-up conditions of the engine.

Yet, it is another object of the present invention to provide a combination of a hydraulic valve lifter and a fluid pressure control device of the above described nature.

THE SUMMARY OF THE INVENTION

In accordance with one important aspect of the present invention, there is provided a valve lift control apparatus for an internal combustion engine, comprising a source of fluid pressure variable with operating conditions of the engine, and a hydraulic valve lifter comprising a hollow, axially elongated stationary lifter cylinder structure, a first plunger axially slidable in the lifter cylinder structure and projecting axially outwardly from one axial end of the lifter cylinder structure, a second plunger axially slidable in the lifter cylinder structure substantially in line with the first plunger and projecting axially outwardly from the other axial end of the lifter cylinder structure, a first piston axially movable between the first and second plungers and forming between the first plunger and the first piston a first fluid chamber which is continuously variable in volume depending upon the axial positions which the first plunger and the first piston assume relative to each other, passageway means for providing communication between the above mentioned source of fluid pressure and the second fluid chamber, and a second piston axially movable between the first piston and the second plunger and forming at least in part between the first and second pistons a second fluid chamber which is continuously variable in volume depending upon the axial positions which the first and second pistons assume relative to each other, the first piston being formed with a hole which is communicable with the first fluid chamber depending upon the axial positions of the first plunger and the first piston relative to each other and which is in constant communication with the second fluid chamber, the second plunger and the second piston having formed at least in part therebetween a third chamber which is continuously variable in volume depending upon the axial positions which the second plunger and the second piston assume relative to each other, the second piston being formed with an orifice providing constant but restricted communication between the second and third fluid chambers therethrough. The lifter cylinder structure preferably has an internal surface portion which is engageable with the second piston in axial direction of the cylinder structure for limiting the axial movement of the second piston toward the first piston and away from the second plunger, the surface portion being exposed to one of the second and third fluid chambers when the second piston is disengaged from the surface portion. In a preferred embodiment of the present invention, the hydraulic valve further comprises displacement limiting means which is fast on one of the first plunger and the first piston for limiting the axial displacement of the first piston relative to the first plunger toward the second piston.

The valve lift control apparatus according to the present invention may further comprise a fluid pressure control device comprising detecting means for detecting predetermined operating conditions of the engine and delivering a signal representative of the detected operating conditions, the predetermined operating conditions including cold starting conditions of the engine, and a pressure relief valve assembly having a fluid inlet port communicating with the above mentioned passageway means and a fluid outlet port communicable with the fluid inlet port, the valve assembly including a valve element movable into and out of a position isolating the fluid inlet and outlet ports from each other, the valve element being operative to be moved out of the position thereof for providing communication between the fluid inlet and outlet ports in the presence of the signal from the aforesaid detecting means.

DESCRIPTION OF THE DRAWINGS

The features and advantages of a valve lift control apparatus according to the present invention will be understood more clearly from the following description taken in conjunction with the accompanying drawings in which like reference numerals designate similar or corresponding structure, members elements and spaces throughout some figures and in which.

FURTHER DESCRIPTION OF THE PRIOR ART

With a view to providing improved fuel economy in a multiple-cylinder internal combustion engine for automotive use, attempts have thus far been made to hold the intake and exhaust valves of some of the power cylinders of the engine in positions closing the associated intake and exhaust ports under low-load operating conditions of the engine for the purpose of achieving increased charging efficiencies for the remaining power cylinders. On the other hand, it has been put into practice to have the amounts of lift of the intake and exhaust valves of an internal combustion engine varied to produce proper amounts of valve overlap between the intake and exhaust valves in each of the power cylinders for controlling the quantities of the residual exhaust gases to remain in the power cylinder for contributing to the combustion of the fuel-air mixture in the subsequent cycle of operation in an internal combustion engine having an emission control system.

Figure 1:
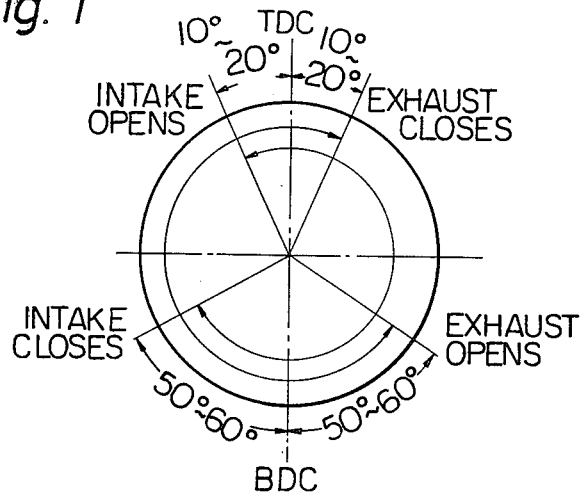
FIG. 1 is a diagram showing an example of the schedule of the valve timings available by a solid valve lifter.

In an internal combustion engine using solid valve lifters in the power cylinders thereof, the amount of lift of each of the intake and exhaust valves of each power cylinder and accordingly the amount of overlap between the intake and exhaust valves of the power cylinder are maintained constant without respect to various operational conditions of the engine. The valve train using a solid valve lifter is therefore so designed as to provide a relatively large amount of valve overlap adequate for the full power operating conditions of the engine. An example of the schedule of the valve timings to produce such a valve overlap is shown in FIG. 1 wherein the valve overlap across the top dead center (TDC) is assumed to range from 20 to 40 degrees of crankshaft rotation angle. When the valves of a power cylinder are timed to provide such a large amount of valve overlap, objectionably large quantities of exhaust gases tend to remain in the power cylinder at the beginning of the intake strokes and impair the combustion efficiency of the power cylinder. If, furthermore, the intake valve of a power cylinder is timed so that the valve does not close until 50 to 60 degrees of crankshaft rotation angle after bottom dead center as shown in FIG. 1 for the purpose of effecting inertia supercharging in the power cylinder, then it may happen that the fresh fuel-air mixture once introduced into the power cylinder flows back into the intake port under low-speed operating conditions of the engine, only to impair the charging efficiency of the power cylinder.

Figure 2:
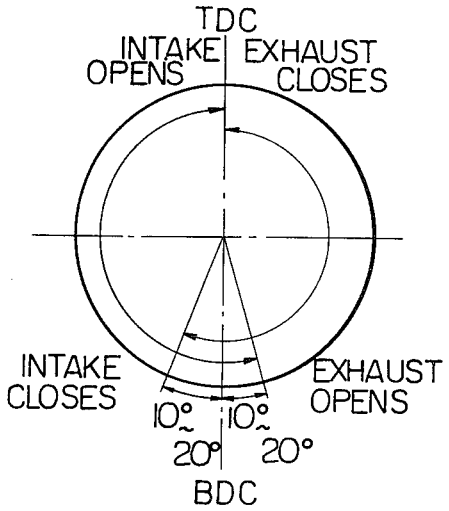
FIG. 2 is a diagram showing an example of the schedule of the valve timings achievable by a hydraulic valve lifter.

To provide a solution to these problems, a hydraulically operated valve lifter has been proposed and put to practical use for varying the amount of valve overlap in accordance with the amount of load applied to the engine. By the use of such a hydraulic valve lifter, the amount of overlap can be reduced or eliminated or the intake and exhaust valves can be timed to respectively close and open immediately after and before the bottom dead center as indicated in FIG. 2 under low-load and/or low-speed operating conditions of the engine. Thus, a hydraulic valve lifter is useful for producing valve timings which are properly variable depending upon the conditions in which the engine is operating.

The present invention contemplates, in the first place, improving the performance quality of a hydraulic valve lifter having such advantages.

The present invention further contemplates provision of a fluid pressure control device which will further improve the performance quality of the hydraulic valve lifter according to the present invention, although such a control device may be used in combination with any known hydraulic valve lifter.

DESCRIPTION OF THE PREFERRED EMBODIMENTS

Figure 3:
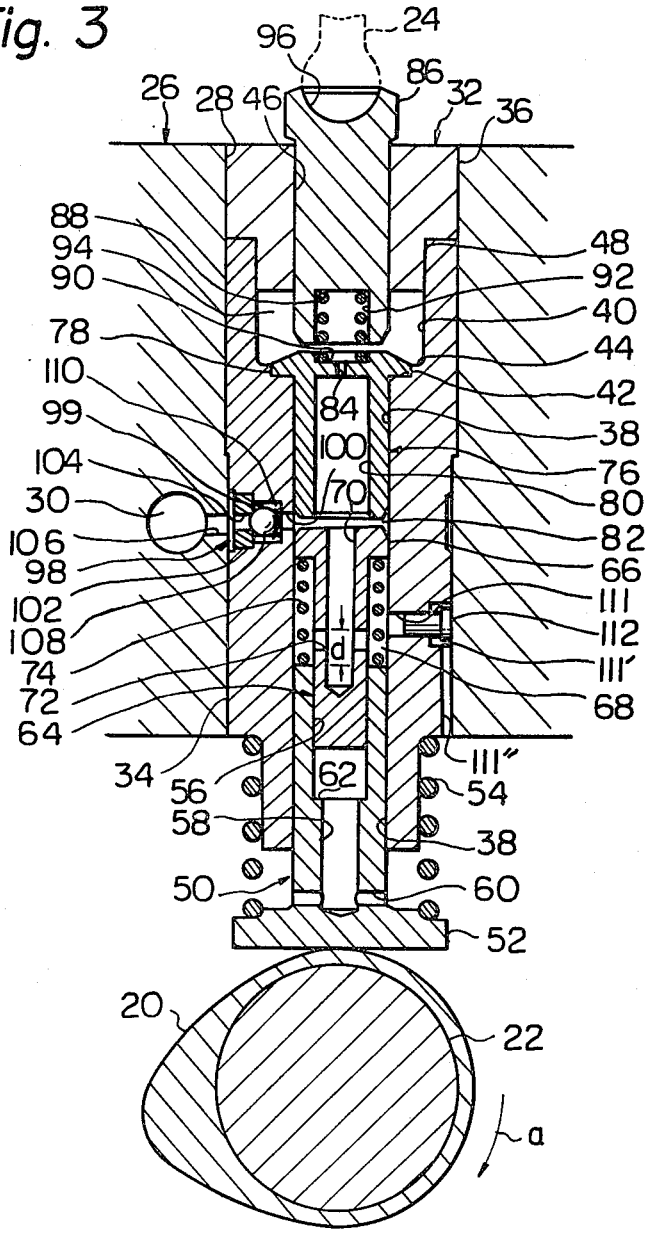
FIGS. 3 to 5 are longitudinal sectional views showing a preferred embodiment, in different operational conditions, of a hydraulic valve lifter forming part of a valve lift control apparatus according to the present invention.
Figure 4:
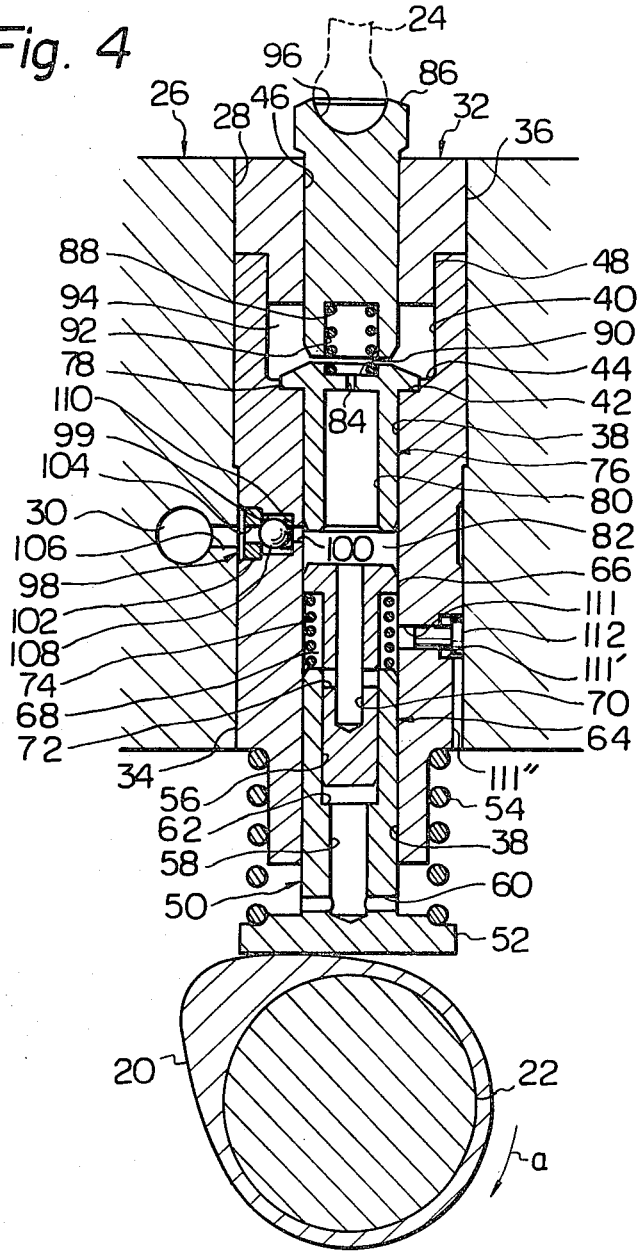
Figure 5:
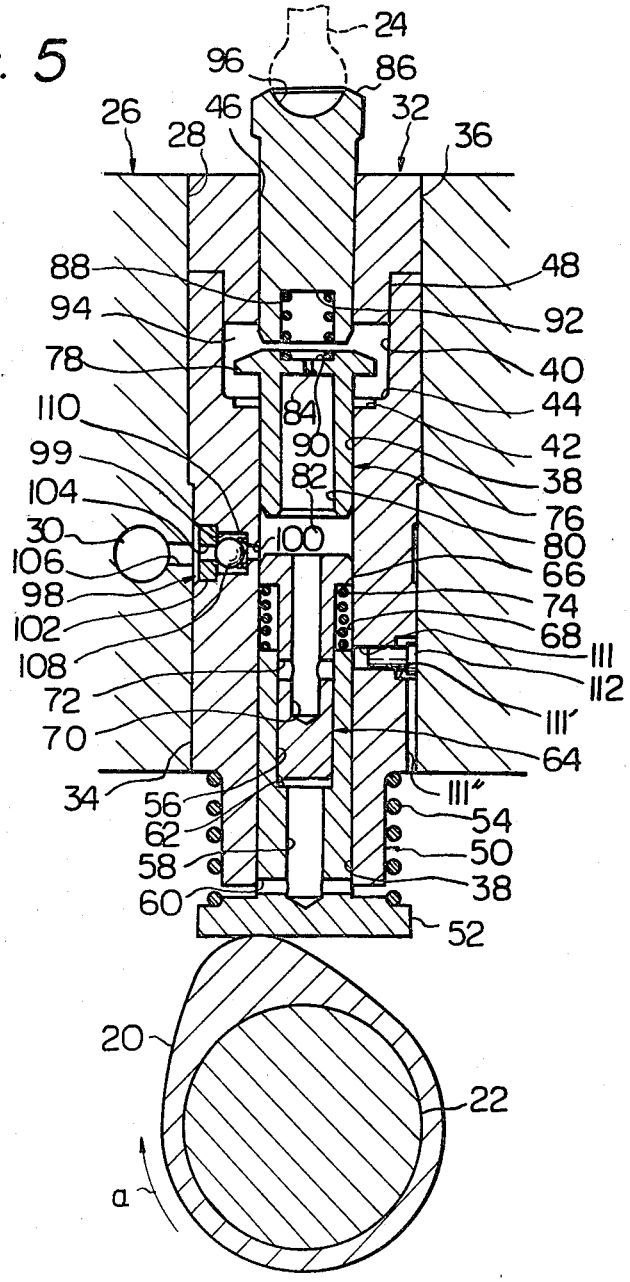

Description will be hereinafter made regarding preferred embodiments of the hydraulic valve lifter according to the present invention. Referring to FIGS. 3 to 5 of the drawings, a hydraulic valve lifter used in an internal combustion engine of, for example, the push-rod type forms part of the valve train of the internal combustion engine and is arranged to operatively intervene between a cam 20 which is secured to or integral with a camshaft 22 and a push-rod 24 connected to the rocker arm (not shown) of a power cylinder included in the engine. Though not shown in the drawings, the camshaft 22 is operatively connected to the crankshaft of the engine through suitable power transmission means such as for example a chain and sprocket wheel or belt and pulley arrangement or a gear mechanism and is driven for rotation about the center axis of the shaft at a speed constantly proportional to the speed of rotation of the crankshaft throughout operation of the engine as is well known in the art. The cam 20 is rotatable with the camshaft 22 about the center axis of the crankshaft so that the push-rod 24 and accordingly the rocker arm connected to the push-rod are driven to operate in cycles dictated by the output speed of the engine. The rocker arm thus connected to and driven by the push-rod 24 is engaged by the intake or exhaust valve (not shown) of the above mentioned power cylinder of the engine so that the intake or exhaust valve is operated to open and close the intake or exhaust port (not shown) of the power cylinder each time the cam 20 makes a full turn about the center axis of the camshaft 22 as is also well known in the art.

The valve lifter thus provided between the cam 20 on the engine camshaft 22 and the push-rod 24 of the power cylinder is mounted on a suitable structural member of the engine such as, in the arrangement herein shown, the cylinder block 26 of the engine through a bore 28 formed in the cylinder block 26 intermediate between the cam 20 and the push-rod 24. The cylinder block 26 is further formed with an engine oil galley a portion of which is indicated at 30 in the drawings. As is well known in the art, the engine oil galley 30 forms part of the lubricating system of the internal combustion engine and is, thus, in constant communication with the delivery side of an engine oil pump (not shown) incorporated into the engine. The engine oil pump is driven by the crankshaft of the engine through a belt and pulley arrangement, for example, and constantly delivers oil under pressure when the engine is in operation. The pressure of the oil thus delivered from the engine oil pump continuously varies with the output speed of the engine between a certain maximum value achieved at the maximum output speed of the engine and a certain minimum value achieved during idling of the engine.

The hydraulic valve lifter comprises a stationary lifter cylinder structure 32 consisting of a lifter cylinder body 34 securely fitting in the bore 28 in the cylinder block 26 and axially projecting from the bore 26 toward the cam 20 on the camshaft 22, and a plug member 36 also securely fitting in the bore 28 in the cylinder block 26 and having an outer end face located adjacent to the push-rod 24. The lifter cylinder body 34 is formed with a first or elongated axial bore portion 38 having one end at the outer axial end of the cylinder body 34 and a second or enlarged axial bore 40 portion having one end at the inner axial end of the cylinder body 34 and larger in cross sectional area than the first or elongated axial bore 38, the two bore portions 38 and 40 axially merging with or contiguous to each other through the respective other ends of the bore portions. Between the bore portions 38 and 40, the lifter cylinder body 34 has an annular internal end face 42 encircling the inner end of the elongated axial bore 38 and defining the inner end of the enlarged axial bore 40. The cylinder body 38 further has an annular internal shoulder or ledge portion 44 substantially concentrically encircling the annular internal end face 42. On the other hand, the plug member 36 of the lifter cylinder structure 32 is formed with an axial bore 46 having ends at the inner and outer axial ends of the plug member and preferably substantially equal in cross sectional area to the cross sectional area of the elongated axial bore 38 in the lifter cylinder body 34 as shown. The plug member 36 further has a reduced axial end portion 48 axially projecting into the enlarged axial bore 40 in the lifter cylinder body 34 and closely secured to an inner axial end portion of the cylinder body 34. The reduced axial end portion 48 of the plug member 36 has an annular end face axially spaced apart from the above mentioned annular internal end face 42 and ledge portion 44 of the cylinder body 34. Between the annular internal end face 44 of the cylinder body 34 and the annular end face of the reduced axial end portion 48 of the plug member 36 is thus formed a cavity which forms part of the enlarged axial bore 40 in the cylinder body 34.

The hydraulic valve lifter shown in FIGS. 3 to 5 further comprises a first or cam follower plunger 50 which axially slidably projects into the elongated axial bore 38 in the lifter cylinder body 34 and which has a laterally enlarged end portion 52 positioned adjacent to and axially movable toward and away from the outer axial end of the cylinder body 34 for engagement with the cam 20 on the camshaft 22. The cam follower plunger 50 is urged to axially move outwardly toward the cam 20 by suitable biasing means such as a preloaded helical compression spring 54 which is shown seated at one end on an annular shoulder portion of the cylinder body 34 and at the other end thereof on the inner end face of the above mentioned end portion 52 of the cam follower plunger 50. The laterally enlarged end portion 52 of the cam follower plunger 50 has a substantially flat or slightly concave outer face which is thus slidably contacted by the cam 20 on the camshaft 22. The cam follower plunger 50 is formed with a first or inner axial bore portion 56 having one end at the inner axial end of the plunger 40 and a second or outer axial bore portion 58 which is open at one end to the first or inner axial bore portion 56 and at the other end thereof to the atmosphere through radial apertures 60 formed in the plunger 40 adjacent to the end portion 52 of the plunger as shown. The second or outer axial bore portion 58 and the radial apertures 60 thus formed in the cam follower plunger 50 constitute in combination a breather passageway providing constant communication between the first or inner axial bore portion 56 in the plunger 50 and the open air as will be understood as the description proceeds. The inner axial bore portion 56 is larger in crosssectional area than the outer axial bore portion 58 so that the cam follower plunger 50 has an annular internal end face 62 encircling the inner end of the outer axial bore portion 58 and defining the inner end of the inner axial bore portion 56.

The cam follower plunger 50 thus engaging the cam 20 on the camshaft 22 and the lifter cylinder body 34 fixed to the cylinder block 26 of the engine is axially movable on the cylinder body 34 between a first limit axial position closest to the center axis of the camshaft 22 as shown in FIG. 3 and a second limit axial position remotest from the center axis of the camshaft 22 as shown in FIG. 5 depending upon the angular positions of the cam 20 about the center axis of the camshaft 22.

A first internal piston 64 has a cylindrical stem portion which axially slidably fits in the inner axial bore portion 56 in the cam follower plunger 50 and which axially projects from the bore portion 56 into the elongated axial bore portion 38 in the lifter cylinder body 34. The first internal pistion 64 further has at its axial end opposite to the cam follower plunger 50 an annular projection or flange portion 66 which is axially slidable on the inner peripheral surface of the lifter cylinder body 34 formed with the elongated axial bore portion 38. Between the annular inner end face of the stem portion of the cam follower plunger 50 projecting into the elongated bore portion 38 of the cylinder body 34 and the annular inner end face of the flange portion 66 of the first internal piston 64 thus slidable in the elongated bore portion 38 is formed an open space 68 which has an annular cross section around the stem portion of the piston 64 and which forms part of the elongated axial bore portion 38 in the lifter cylinder body 34. The open space 68 thus formed between the stem portion of the cam follower plunger 50 and the flange portion 66 of the first internal piston 64 is continuously variable in volume depending upon the relationship between the axial positions which the cam follower plunger 34 and the first internal piston 64 assume with respect to each other. Such a variable-volume open space 68 forms a first fluid chamber in the hydraulic valve lifter embodying the present invention.

The first internal piston 64 is formed with an axial bore 70 which is open at the inner axial end of the stem portion of the piston 64 to the elongated axial bore portion 38 in the lifter cylinder body 34 and which is closed at a suitable distance from the open inner end of the piston 64. The first internal piston 64 has further formed in its stem portion a suitable number of radial holes 72 each open at one end to the axial bore 70 in the piston 64 and at the outer periphery of the stem portion of the piston 64. The distance of the radial holes 72 from each axial end, particularly the inner axial end, of the piston 64 is predetermined in relation to the axial positions which the cam follower plunger 50 and the piston 64 assume with respect to each other when the cam follower plunger 50 is in the previously mentioned first and second limit axial positions thereof as will be discussed in more detail. The cam follower plunger 50 and the first internal piston 64 thus constructed and arranged are urged by suitable biasing means to axially move relative to each other in directions in which the internal piston 64 axially projects outwardly from the first axial bore portion 56 in the plunger 50, viz., the first fluid chamber 68 formed between the plunger 50 and the piston 64 axially expands. In the arrangement herein shown, such biasing means is assumed to consist of a preloaded helical compression spring 74 which is coaxially surrounding part of the stem portion of the piston 64 and which is seated at one end on the inner end face of the cam follower plunger 50 and at the other end on the annular inner end face of the flange portion 66 of the piston 64.

In series with the first internal piston 64 thus arranged is provided a second internal piston 76 having a cylindrical stem portion axially slidable in the elongated axial bore portion 38 in the lifter cylinder body 34 and projecting toward the annular flange portion 66 of the first internal piston 64 and a generally disc-shaped end wall 78 positioned and axially movable within the previously mentioned open space formed between the annular internal end face 42 of the lifter cylinder body 34 and the reduced axial end portion 48 of the plug member 36 and forming part of the enlarged axial bore 40 in the cylinder body 34. The disc-shaped end wall 78 of the second internal piston 76 has a circular rim portion radially projecting from the stem portion of the piston 76 and engageable with the annular internal end face 42 of the lifter cylinder body 34. The stem portion of the internal piston 76 is formed with an axial bore 80 which is open at its end opposite to the end wall 78 of the piston 76. The first and second internal pistons 64 and 76 are axially aligned with each other and have formed therebetween an open space 82 forming part of the elongated axial bore portion 38 in the lifter cylinder body 34. The axial bores 70 and 80 formed in the respective stem portions of the first and second internal pistons 64 and 76 are open to each other through the open space 82 thus formed between the pistons 64 and 76 and form in the valve lifter embodying the present invention a continuous second fluid chamber including the respective axial bores 70 and 80 in the pistons 64 and 76 and the open space 82 forming part of the elongated axial bore portion 38 in the lifter cylinder body 34. The second fluid chamber is continuously variable in volume with the volume of the open space 82 and accordingly depending upon the axial spacing between the first and second internal pistons 64 and 76. The disc-shaped end wall 78 of the second internal piston 76 is formed with an orifice 84 providing constant communication between the axial bore 80 in the piston 76 and the above mentioned open space forming part of the enlarged axial bore portion 40 in the lifter cylinder body 34. The axial movement of the second internal piston 76 toward the first internal piston 64 is limited by engagement between the rim portion of the end wall 78 of the second internal piston 76 and the annular internal end face 42 of the lifter cylinder body 34 as will be seen from FIGS. 3 and 4. Thus, the outer rim portion of the end wall 78 of the second internal piston 76 and the annular internal end face 42 of the lifter cylinder body 34 constitute in combination displacement limiting means for limiting the axial displacement of the piston 76 toward the first internal piston 64.

The hydraulic valve lifter embodying the present invention further comprises a second or push-rod drive plunger 86 which is axially slidable in the axial bore 46 in the plug member 36 and which axially projects into the open space between the annular internal end face 42 of the lifter cylinder body 34 and the reduced inner axial end portion 48 of the plug member 36 toward the disc-shaped end wall 78 of the above described second internal piston 76 as shown. The push-rod drive plunger 86 and the second internal piston 76 are positioned substantially in line with and axially movable toward and away from each other and are urged by suitable biasing means to axially move away from each other. Such biasing means is shown comprising a preloaded helical compression spring 88 seated at one end in a shallow depression 90 formed in the end wall 78 of the second internal piston 76 and at the other end in a blind axial bore 92 formed in an inner axial end portion to the push-rod drive plunger 86. Thus, the hydraulic valve lifter embodying the present invention has a third fluid chamber 94 which is formed in part by the depression 90 in the second internal piston 76 and the blind axial bore 92 in the push-rod drive plunger 86 and in part by an unoccupied portion of the enlarged axial bore portion 40 in the lifter cylinder body 34. The third fluid chamber 94 of the valve lifter is continuously variable in volume depending upon the axial positions of the piston 76 and the plunger 86 with respect to the cylinder body 34 and the plug member 36 constituting the lifter cylinder structure 32 and is in constant communication with the second fluid chamber of the valve lifter through the orifice 84 in the end wall 78 of the second internal piston 76. The push-rod drive plugner 86 has an outer axial end portion which is semispherically dished out as at 96 for slidably receiving therein a rounded end portion of the push rod 24. By means of the compression spring 88 provided between the push-rod drive plunger 86 and the second internal piston 76, the plunger 86 is urged to maintain engagement with the rounded end portion of the push rod 24 while the second internal piston 76 is urged to hold its axial position having the rim portion of its end wall 78 seated on the annular internal end face 42 of the lifter cylinder body 34.

The hydraulic valve lifter shown in FIGS. 3 to 5 further comprises a check valve 98 providing one-way communication from the engine oil gallery 30 in the cylinder block 26 to the second fluid chamber of the valve lifter. For this purpose, the lifter cylinder body 34 is further formed with a valve chamber 99 which is open at one end to the previously mentioned open space 82 between the first and second internal pistons 64 and 76 through a port 100 also formed in the cylinder body 34. At the other end of the valve chamber 99 is positioned an annular seat element 102 secured to the lifter cylinder body 34 and having an aperture 104 which is in constant communication with the engine oil gallery 30 in the cylinder block 26 through a fluid passageway 106 branched in the cylinder block 26 from the engine oil gallery 30. Within the valve chamber 99 thus arranged is positioned a valve ball 108 which is movable between the port 100 at one end of the valve chamber 99 and the aperture 104 in the seat element 102 at the other end of the valve chamber 99. The valve ball 108 is pressed against the seat element 102 to close the aperture 104 therein by means of a preloaded helical compression spring 110 also provided within the valve chamber 99.

The hydraulic valve lifter embodying the present invention further comprises suction compensating means to prevent an occurrence of cavitation in the first fluid chamber 68 of the valve lifter. The vacuum compensating means comprises a radial hole 111 formed in the lifter cylinder body 34 and open at its inner radial end to the first fluid chamber 68 and at its outer radial end to a concavity 111' also formed in the cylinder body 34 and larger in cross sectional area than the radial hole 111 as shown. A free piston 112 having a flange portion positioned and movable within the concavity 111' is axially slidable through the radial hole 111 into and out of the first fluid chamber 68. The concavity 111' in the lifter cylinder body 34 is open to the atmosphere through a suitable breather passageway which is shown to be provided by a groove 111'' formed in the cylinder body 34 and open to the atmosphere adjacent the annular shoulder portion of the cylinder body 34.

The operation of the hydraulic valve lifter embodying the present invention will be hereinafter described with successive reference to FIGS. 3 to 5 of the drawings.

Throughout operation of the engine, a fluid pressure continuously varying with the output speed of the engine is constantly developed in the engine oil gallery 30 in the cylinder block 26 of the engine. The fluid pressure is directed through the fluid passageway 106, past the valve ball 108 and further through the port 100 in the lifter cylinder body 34 into the open space 82 between the first and second internal pistons 64 and 76. The fluid pressure thus developed in the second fluid chamber 70, 80 and 82 of the valve lifter acts on the first and second internal pistons 64 and 76, which are accordingly urged to axially move away from each other against the forces of the compression springs 74 and 88, respectively. Strictly, the fluid pressure urging the first internal piston 64 to move axially away from the first internal piston 76 is opposed not only by the force of the compression spring 74 engaging the piston 64 but by the atmosheric pressure which acts on the piston 64 through the radial apertures 60 and the second axial bore portion 58 in the cam follower plunger 50. On the other hand, the fluid pressure urging the second internal piston 76 to move axially away from the first internal piston 64 is opposed not only by the force of the spring 88 engaging the piston 76 but the fluid pressure acting on the disc-shaped end wall 78 of the piston 76 in the presence of a fluid pressure in the third fluid chamber 94.

When the cam 20 on the camshaft 22 assumes about the center axis of the camshaft 22 an angular position bearing on its circular low cam lobe portion against the end portion 52 of the cam follower plunger 50 as shown in FIG. 3, the cam follower plunger 50 is in the previously mentioned first limit axial position closest to the center axis of the camshaft 22. The cam follower plunger 50 being in the first limit axial position thereof, the first internal piston 64 assumes with respect to the cam follower plunger 50 a certain equilibrium axial position which is determined by the fluid pressure acting on the piston 64, the force of the spring 74 and the atmospheric pressure acting on the outer axial end face of the stem portion of the piston 64. When the first internal piston 64 is in such an equilibrium axial position relative to the cam follower plunger 50, the radial holes 72 in the stem portion of the first internal piston 64 are located out of the first axial bore portion 56 in the cam follower plunger 50 and are thus open to the first fluid chamber 68 axially extending between the inner axial end of the plunger 50 and the flange portion 66 of the piston 64, thereby providing communication between the first fluid chamber 68 and the second fluid chamber 70, 80 and 82 of the valve lifter. The equilibrium axial position of the first internal piston 64 with respect to the cam follower plunger 50 varies with the fluid pressure acting on the piston 64 and accordingly with the output speed of the engine and becomes the remoter from the second internal piston 76 as the output speed of the engine becomes higher. Thus, the distance d between the inner axial end of the cam follower plunger 50 and the farthest ends of the radial holes 72 in the stem portion of the first internal piston 64 from the inner axial end of the cam follower plunger 50 at a given point of time is determined by the output speed of the engine substantially at the particular point of time. The fluid pressure directed into the axial bore 80 in the second internal piston 76 is passed at a restricted rate into the third fluid chamber 94 through the orifice 84 in the end wall 78 of the piston 76 and acts on the outer end faces of the end wall 78 of the piston 76. The second internal piston 76 is therefore held in the axial position having the rim portion of its end wall 78 seated on the annular internal end face 42 of the lifter cylinder body 34 by the fluid pressure thus acting on the outer end faces of the end wall 78 and the force of the compression spring 88 seated under compression between the second internal piston 76 and the push-rod drive plunger 86. The fluid pressure developed in the third fluid chamber 94 also acts on the push-rod drive plunger 86, which is therefore urged to move axially away from the second internal piston 76 by the fluid pressure thus acting thereon and the force of the compression spring 88. The force thus urging the push-rod drive plunger 86 to axially project from the plug member 36 are resisted by the push-rod connected to the spring loaded intake or exhaust valve of the power cylinder so that the push-rod drive plunger 86 is maintained at rest in the axial position illustrated in FIG. 3.

As the cam 20 is rotated in the direction of arrow a about the center axis of the camshaft 22 so that the protruded or high cam lobe portion of the cam 20 is brought into sliding contact with the outer end face of the end wall portion 52 of the cam follower plunger 50 as shown in FIG. 4, the cam follower plunger 50 is caused to axially move away from the first limit axial position thereof against the force of the compression spring 54 so that the plunger 50 and the first internal piston 64 are axially moved relative to each other against the force of the compression spring 74 in directions in which the inner axial end of the former approaches the radial holes 72 in the stem portion of the latter. The plunger 50 and the piston 64 being thus moved relative to each other, the first fluid chamber 68 between the plunger 50 and piston 64 is reduced in volume by a value corresponding to the axial displacement between the two members and urges the fluid in the first and second fluid chambers 68, 70, 80 and 82 to withdraw therefrom. A withdrawal of the fluid from the valve lifter being prevented by the one-way check valve 98, the fluid once introduced into the valve lifter is entrapped therein so that the axial displacement between the cam follower plunger 50 and the first internal piston 64 gives rise to a gradual increase in the fluid pressure in the first and second fluid chambers 68, 70, 80 and 82. The increased fluid pressure acts on the first internal piston 64 and causes the piston 64 to axially move relative to the cam follower plunger 50 toward the second axial bore portion 58 in the plunger 50, viz., in a direction in which the radial holes 72 in the stem portion of the first internal piston 64 approach the inner axial end of the cam follower plunger 50. While the radial holes 72 in the stem portion of the first internal piston 64 remain uncovered by an inner axial end portion of the cam follower plunger 50, the reduction in the volume of the first fluid chamber 68 is compensated for by an escape of fluid from the first fluid chamber 68 into the second fluid chamber 70, 80 and 82 through the radial holes 72 in the stem portion of the first internal piston 64, which is therefore urged to axially move away from the second internal piston 76 with a fluid pressure attempting to increase with the movement of the cam follower plunger 50 away from the first limit axial position thereof. The fluid pressure thus attempting to increase extends through the orifice 84 in the end wall 78 of the second internal piston 76 into the third fluid chamber 94 and, in cooperation with the force of the compression spring 88, urges the push-rod drive plunger 86 to move away from the second internal piston 76. The forces thus exerted on the push-rod drive plunger 86 by the spring 88 and the fluid pressure in the third fluid chamber 94 are, however, still of such values that can not overcome the force being exerted on the push-rod drive plunger 86 by the spring loaded intake or exhaust valve engaging the plunger 86 through the push rod 24 and the associated rocker arm (not shown), the push-rod drive plunger 86 is maintained in situ and, as a consequence, the volume of the third fluid chamber 94 remains unchanged. In the result, the fluid pressure attempting to increase in the valve lifter causes axial movement of the first internal piston 64 away from the second internal piston 76 against the force of the compression spring 74 so that the reduction in the volume of the first fluid chamber 68 as caused by the axial movement of the cam follower plunger 50 away from the first limit axial position thereof is, in this fashion, largely compensated for by axial expansion of the open space 82 between the first and second internal pistons 64 and 76 without causing an appreciable increase in the fluid pressure in the valve lifter. Thus, the axial movement of the cam follower plunger 50 away from the first limit axial position thereof takes no effect on the push-rod drive plunger 86 as long as communication is established between the first fluid chamber 68 and the second fluid chamber 70, 80 and 82 of the valve lifter according to the present invention.

When the cam follower plunger 50 being thus moved away from the first axial position thereof reaches a certain axial position in which the plunger 50 and the first internal piston 64 are axially displaced relative to each other by the previously mentioned distance d (FIG. 3) from their respective initial axial positions relative to each other, the radial holes 72 in the stem portion of the first internal piston 64 are closed by an inner axial end portion of the cam follower plunger 50 so that the first fluid chamber 68 is isolated from the second fluid chamber 70, 80 and 82. The first fluid chamber 68 being thus confined between the plunger 50 and the piston 64, the plunger 50 and piston 64 are axially moved as a single unit toward the second internal piston 76 through the elongated axial bore portion 38 in the stationary lifter cylinder body 34. From this point of time onward, the axial movement of the cam follower plunger 50 away from the first limit axial position thereof gives rise to a gradual increase in the fluid pressure in the second fluid chamber 70, 80 and 82. The increased fluid pressure in the second fluid chamber 70, 80 and 82 urges the second internal piston 76 to move upwardly and causes an increase in the fluid pressure in the third fluid chamber 94. While the push-rod 24 is in a raised position, the fluid pressure in the third fluid chamber 94 is reduced by the value dictated by the force of the compression spring 88 so that the plunger 76 is gradually moved away from the push-rod plunger 86 by the force of the spring 88 while allowing fluid to flow through the orifice 24 into the fluid chamber 94. When the amount of cam lift is decreasing, the push-rod plunger 86 is moved downwardly in consequence of a decrease in the fluid pressure caused by the downward movement of the cam follower plunger 50 and the piston 64. As the plunger 86 approaches the piston corresponding to the position of the intake or exhaust valve fully closed, the rim portion of the disc-shaped end wall 78 of the second internal piston 76 is moved closer to the annular internal end face 42 of the lifter cylinder body 34, thereby forming a thin layer of fluid between the rim portion and the end face 42. The layer of the fluid thus formed between the rim portion of the end wall 78 of the plunger 76 and the internal end face 42 of the cylinder body 34 resists the downward movement of the piston 76 and causes the fluid pressure in the chamber 94 to increase. As a consequence, the plunger 86 is moved downwardly and permits the intake or exhaust valve to seat smoothly while causing the fluid in the fluid chamber 94 to flow through the orifice 84 into the second fluid chamber 70, 80 and 82.

As the cam 20 is further turned in the direction of the arrow a about center axis of the camshaft 22 and as a consequence the cam follower plunger 50 moving with the first internal piston 64 is axially moved farther from the second limit axial position thereof, the fluid pressure in the second fluid chamber 70, 80 and 82 will reach such a value that the force exerted on the first internal piston 64 by the fluid pressure is overcome by the sum of the compression spring 74 and the pressure of the fluid confined in the first fluid chamber 68 between the cam follower plunger 50 and the first internal piston 76. From this point of time onward, the first internal piston 64 is allowed to axially move relative to the cam follower plunger 50 in the direction to axially expand the first fluid chamber 68 by the force of the compression spring 74 and initially further by the fluid pressure in the first fluid chamber 68. As the first fluid chamber 68 is thus axially expanded with the radial holes 72 in the stem portion of the first internal piston 64 kept closed by an inner axial end portion of the cam follower plunger 50, a suction which may lead to occurrence of cavitation tends to be developed in the first fluid chamber 68. The suction extends into the radial hole 111 open to the first fluid chamber 68 and acts on the free piston 112 which is axially slidable through the radial hole 111. The free piston 112 forming part of the suction compensating means is therefore caused to axially project into the first fluid chamber 68 and compensates for the increment in the volume of the fluid chamber 68 so as to eliminate the suction and thereby preclude on occurrence of cavitation in the first fluid chamber 68.

As the cam 20 on the camshaft 22 is further rotated in the direction of the arrow a about the center axis of the camshaft 22, the cam follower plunger 50 and the first internal piston 64 assume relative to each other such axial position that the radial holes 72 in the latter are open to the first fluid chamber 68 past the inner peripheral edge of the inner axial end portion of the former. Communication is thus provided between the first fluid chamber 68 and the second fluid chamber 70, 80 and 82 through the radial holes 72 in the first internal piston 64 so that the fluid pressure in the second fluid chamber is admitted into the first fluid chamber and causes the free piston 112 of the suction compensating means to axially retract from the first fluid chamber 68. The first internal piston 64 is now moved with respect to both of the lifter cylinder body 34 and the cam follower plunger 50 into the previously mentioned equilibrium axial position dictated by the relationship between the force of the compression spring 74, the fluid pressure in the first and second fluid chambers 68, 70, 80 and 82 and the atmospheric pressure in the first and second axial bore portions 56 and 58 of the cam follower plunger 50 which is being moved by the force of the compression spring 54 toward the first limit axial position thereof as the cam 20 turns about the center axis of the camshaft 22.

With the hydraulic valve lifter thus constructed and operative, the timings at which the intake or exhaust valve actuated by the push-rod drive plunger 86 of the valve lifter is to open and close the intake or exhaust port and the amount of lift of the valve are determined by the timings at which the radial holes 72 in the stem portion of the first internal piston 64 are to be closed and re-opened by the cam follower plunger 50. The timings at which the radial holes 72 are to be closed and re-opened are, in turn, dictated by the distance d between the inner axial end of the cam follower plunger 50 and the farthest ends of the radial holes 72 from the inner axial end of the plunger 50 in the first limit axial position thereof as indicated in FIG. 3. Such a distance d, in turn, is determined by the axial position of the first internal piston 64 relative to the cam follower plunger 50 in the first limit axial position thereof and accordingly by the relationship between the fluid pressure in the first and second fluid chambers 68, 70, 80 and 82, the atmospheric pressure acting on the valve lifter and the force of the compression spring 74. The force of the spring 74 being given definitely and the atmospheric pressure being practically constant, the distance d is variable with the fluid pressure in the first and second fluid chambers of the valve lifter and accordingly with the fluid pressure developed in the engine oil gallery 30. As the fluid pressure in the engine oil gallery 30 increases, the distance d becomes shorter and as a consequence the radial holes 72 in the first internal piston 64 are closed the earlier by the cam follower plunger 50. The earlier the timings at which the radial holes 72 are closed, the earlier the timings at which the intake or exhaust valve actuated by the valve lifter is to be made open and accordingly the larger the amount of lift of the intake or exhaust valve. If, conversely, the fluid pressure supplied from the engine oil gallery 30 to the valve lifter becomes lower, the timings at which the intake or exhaust valve is to be made open becomes the later and as a consequence the amount of lift of the intake or exhaust valve is made the smaller. If, therefore, the fluid pressure supplied to the valve lifter is lower than a certain level during a certain cycle of operation of the power cylinder, the intake or exhaust valve of the power cylinder will be permitted to stay inoperative for opening movement. The fluid pressure in the engine oil gallery 30 being variable with the output speed of the engine, the amount of lift of the intake or exhaust valve increases as the output speed of the engine increases. Conversely, the lower the output speed of the engine, the smaller the amount of lift of the intake or exhaust valve will be. The amount of overlap of the intake or exhaust valve can be thus varied depending upon the output speed of the engine.

Figure 6:
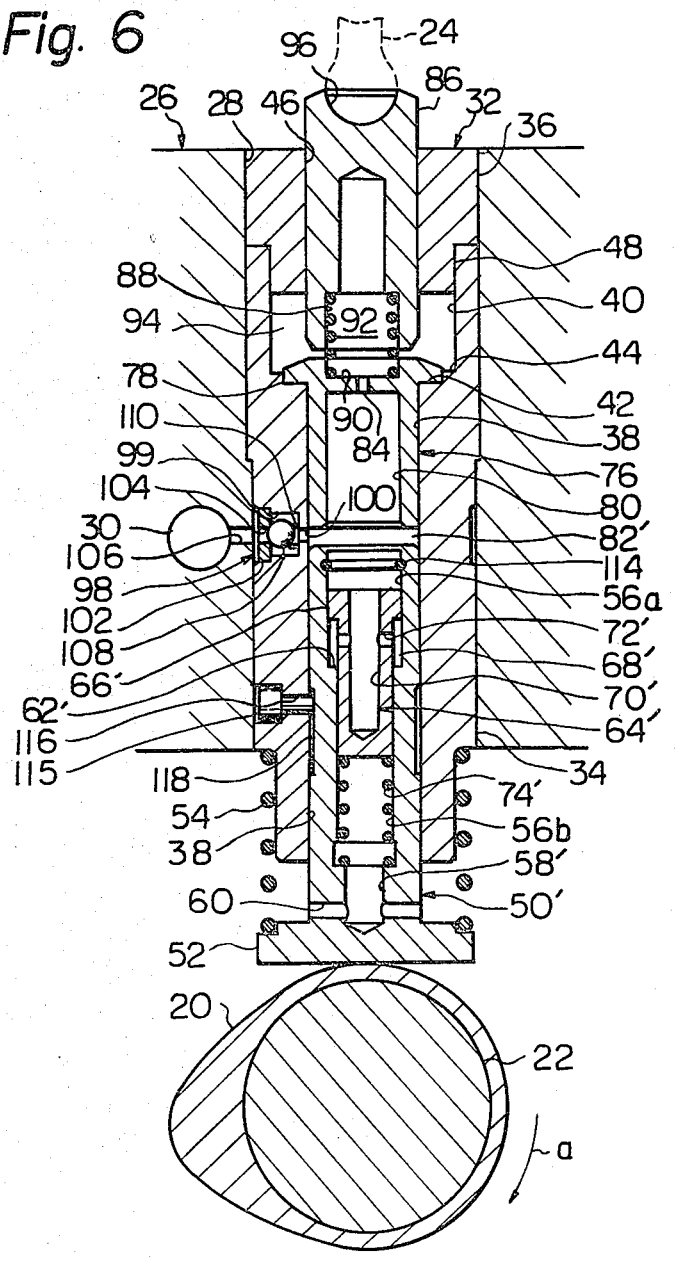
FIGS. 6 to 8 are views similar to FIGS. 3 to 5, respectively, but shows another preferred embodiment, in different operational conditions, of the hydraulic valve lifter forming part of a valve lift control apparatus according to the present invention.
Figure 7:
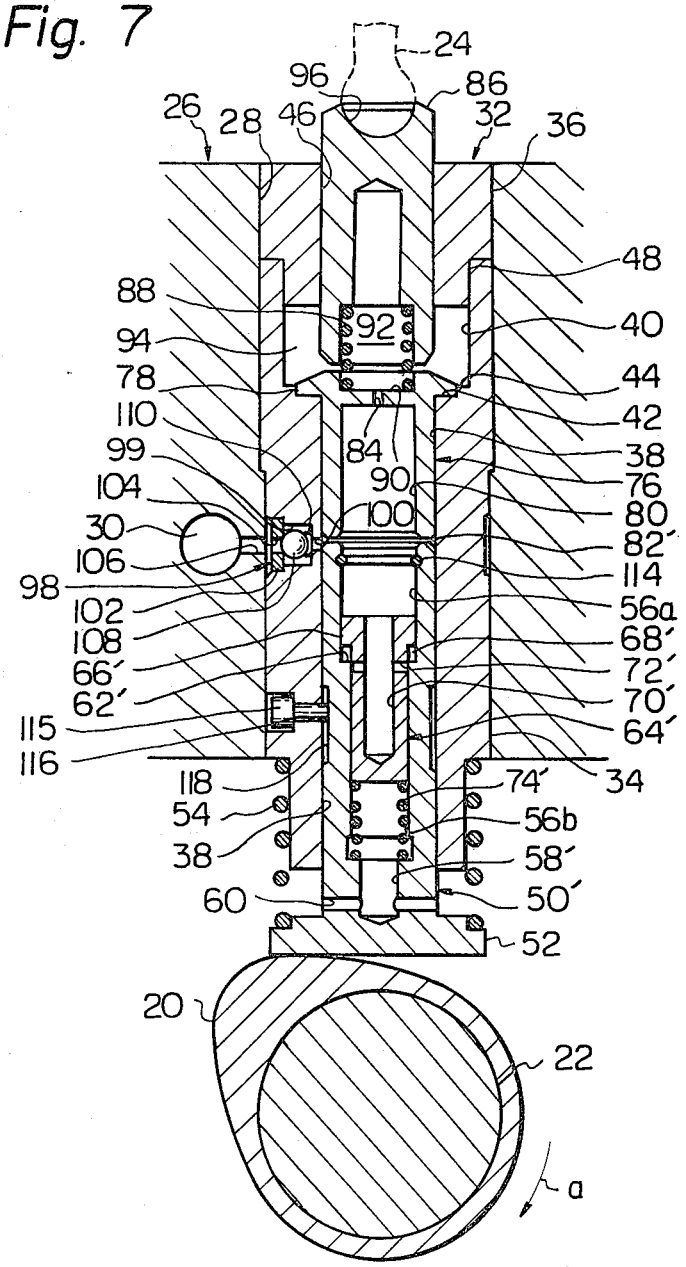
Figure 8:
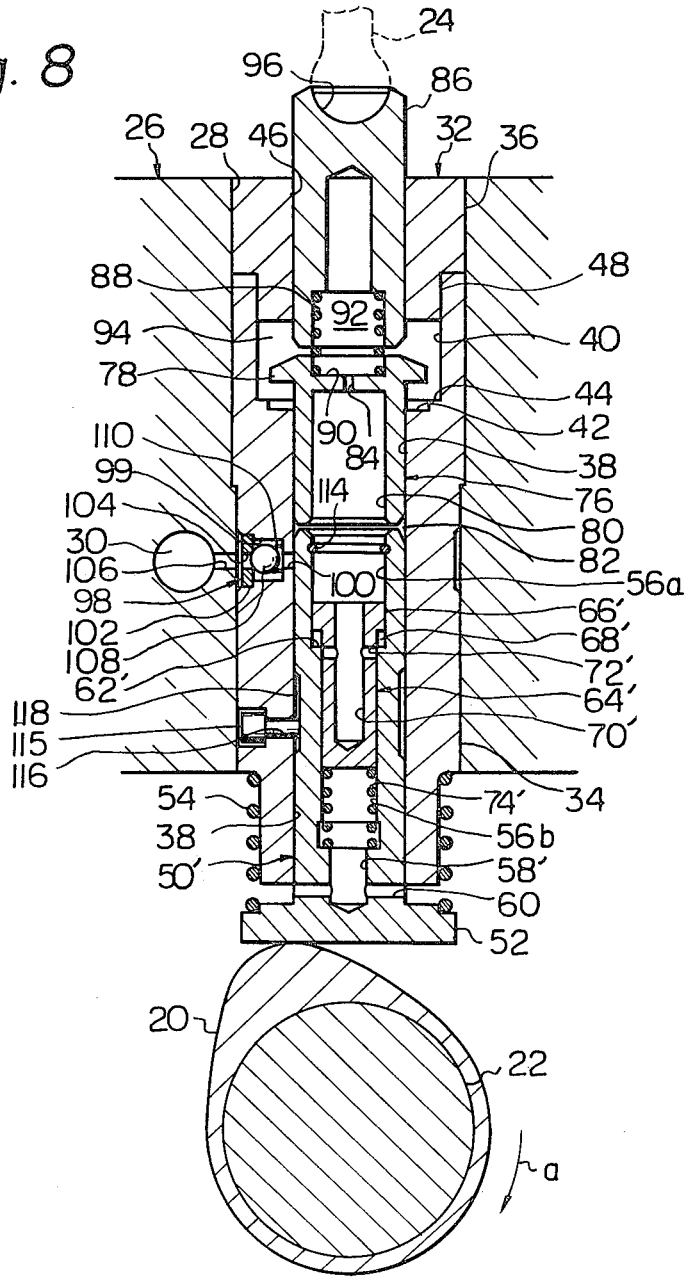

FIGS. 6 to 8 show a modification of the embodiment which has thus far been described with reference to FIGS. 3 to 5. In FIGS. 6 to 8, the structures, members and elements respectively similar or corresponding to those of the embodiment of FIGS. 3 to 5 are designated by like reference numerals with primes affixed to some of the numerals. In the embodiment illustrated in FIGS. 6 to 8, the cam follower plunger designated by numeral 50' is axially elongated to have its inner axial end located in the vicinity of the open axial end of the second internal piston 76. Between the adjacent ends of the cam follower plunger 50' and the second internal piston 76 is thus formed an open space 82' which forms part of the elongated axial bore portion 38 in the lifter cylinder body 34 and which is continuously variable in volume depending upon the axial spacing between the plunger 50' and the piston 76. The open space 82' is constantly open to the port 100 leading from the valve chamber 99 of the one-way check valve 98 provided in an axial wall portion of the lifter valve body 34. The cam follower plunger 50' is formed with first, second and third axial bore portions **56*a*, 56*b* and 58' which are axially arranged in series in the plunger 50'. The third axial bore portion 58' of the plunger 50' corresponds to the second axial bore portion 58 in the cam follower plunger 50 of the embodiment of FIGS. 3 to 5 and is, thus, open to the atmosphere through the radial apertures 60 formed in the cam follower plunger 50' adjacent to the laterally enlarged end wall portion 52 of the plunger 50. The first axial bore portion 56*a* of the plunger 50' is directly open to the above mentioned open space 82' formed between the plunger 50' and the second internal piston 76 and through the open space 82' to the axial bore 80 in the second internal piston 76. The second axial bore portion 56*b* of the cam follower plunger 50' is smaller in cross sectional area than the first axial bore portion 56*a* of the plunger 50' and axially intervenes between the first and third axial bore portions 56*a* and 58' as shown. Thus, the cam follower plunger 50' has an annular internal end face 62' at the inner axial end of the first axial bore portion 56*a*. The first internal piston designated by 64', of the embodiment shown in FIGS. 6 to 8 has a cylindrical stem portion which axially slidably fits in the second axial bore portion 56*b* of the cam follower plunger 50' and which axially projects from the second axial bore portion 56*b* into the first axial bore portion 56*a* of the plunger 50'. The first internal piston 64' further has at its axial end closer to the inner axial end of the cam follower plunger 50' an annular projection or flange portion 66' which is axially slidable on the inner peripheral surface defining the first axial bore portion 56*a* in the plunger 50'. Between the above mentioned inner peripheral surface of the cam follower plunger 50' and the stem portion of the first internal piston 64' is thus formed an open space 68' having an annular cross section around the stem portion of the first internal piston 64' and forming part of the first axial bore portion 56*a* in the cam follower plunger 50'. The open space 68' thus formed between the above mentioned annular internal end face 62' of the cam follower plunger 50' and the annular flange portion 66' of the first internal piston 64' is continuously variable in volume depending upon the relationship between the axial position which the plunger 50' and the piston 64' assume with respect to each other. Such a variable-volume open space 68' forms the first fluid chamber in the valve lifter illustrated in FIGS. 6 to 8. On the other hand, the axial bore 70' in the first internal piston 64' forms part of a continuous second fluid chamber which consists essentially of the axial bores 70' and 80 in the first and second internal pistons 64' and 76, respectively, and the above mentioned open space 82' formed between the pistons 64' and 76. The second fluid chamber 70', 80 and 82' is continuously variable in volume depending upon the axial positions which the cam follower plunger 50' and the first and second internal pistons 64' and 76** assume relative to each other.

The first internal piston 64' is formed with an axial bore 70' which is open at one end to the first axial bore portion **56*a* in the cam follower plunger 50' and closed at a suitable distance from the open inner end of the bore 70'. The first internal piston 64' has further formed in its stem portion a suitable number of radial holes 72' each open at one end to the axial bore 70' in the piston 64' and at the other end thereof at the outer periphery of the stem portion of the piston 64'. The radial holes 72' thus formed in the stem portion of the first internal piston 64' are permitted to be open to or isolated from the above mentioned first fluid chamber 68' depending upon the axial positions which the piston 64' and the cam follower plunger 50' assume relative to each other. The cam follower plunger 50' and the first internal piston 64' thus constructed and arranged are urged by suitable biasing means to axially move relative to each other in directions in which the piston 64' axially projects from the second axial bore portion 56*b* into the first axial bore portion 56*a* in the cam follower plunger 50', viz., the first fluid chamber 68' formed between the plunger 50' and the piston 64' axially expands. In the arrangement herein shown, such biasing means is assumed to consist of a preloaded helical compression spring 74' positioned in the second axial bore portion 56*b* of the cam follower plunger 50' and seated at one end on the closed outer axial end face of the first internal piston 64' and at the other end on the annular internal end face 62' of the plunger 50'**.

To limit the axial displacement of the first internal piston 64' toward the open inner axial end of the cam follower plunger 50', the embodiment illustrated in FIGS. 6 to 8 is provided with displacement limiting means which comprises an annular element such as a snap ring 114 closely received in a circumferential groove formed in an inner peripheral wall of an inner axial end portion of the cam follower plunger 50'. When the first internal piston 64' is moved relative to the cam follower plunger 50' toward the open inner axial end of the plunger 50', the piston 64' is brought into engagement at the outer peripheral of its flange portion 66' against the snap ring 114 thus provided in the vicinity of the open inner axial end of the plunger 50' and is prevented from being axially moved beyond the snap ring 114.

The embodiment illustrated in FIGS. 6 to 8 further comprises, by preferance, means adapted to prevent the cam follower plunger 50' from being moved out of the elongated axial bore portion 38 in the lifter cylinder body 34. Such means is shown comprising a pin or any element 115 axially projecting through a radial hole 116 in an axial wall portion of the lifter cylinder body 34 into an axial groove 118 formed in an axial wall portion of the cam follower plunger 64'. The length of the axial groove 118 thus formed in the cam follower plunger 50' is substantially equal to or slightly longer than the distance of stroke of the plunger 50' between the first and second limit axial positions thereof as will be readily understood.

When, in operation, the cam follower plunger 50' is being contacted by a circular or low cam lobe position of the cam 20 on the camshaft 22 and is accordingly held in the first limit axial position thereof as shown in FIG. 6, the first internal piston 64' assumes with respect to the plunger 50' a certain equilibrium axial position determined by the fluid pressure in the second fluid chamber 70', 80 and 82', the force of the spring 74' and the atmospheric pressure in the second axial bore portion **56*b* of the plunger 50'. The radial holes 72' in the first internal piston 64' held in such an equilibrium axial position are open to the first fluid chamber 68' so that communication is provided between the first fluid chamber 68' and the second fluid chamber 70', 80 and 82'. The fluid pressure in the second fluid chamber 70', 80 and 82' is directed through the radial holes 72' in the piston 64' into the first fluid chamber 68' and through the orifice 84 in the second internal piston 76 into the third fluid chamber 94. By the fluid pressure thus developed in the third fluid chamber 94 and the force of the spring 88, the second internal piston 76 is held in the axial position having the outer rim portion of its disc shaped end wall 78 seated on the annular internal end face 42 of the lifter cylinder body 34, while the push-rod drive plunger 86 is held in pressing engagement with the push-rod 24**.

When the cam follower plunger 50' is thereafter initiated into motion to move away from the first limit axial position thereof with the cam 20 being turned to have its protruded or high cam lobe portion brought into contact with the plunger 50' as shown in FIGS. 7 and 8, the fluid pressure in the first and second fluid chambers 68', 70', 80 and 82' attempts to increase and causes the first internal piston 64' to axially move relative to the plunger 50' away from the open end of the first axial bore portion **56*a* in the plunger 50' against the force of the compression spring 74' until the radial holes 72' in the piston 64' are closed by the inner peripheral surface defining the second axial bore portion 56*b* in the cam follower plunger 50'. After the radial holes 72' in the first internal piston 64' are closed by the cam follower plunger 50', the first fluid chamber 68' is isolated from the axial bore 70' in the piston 64' and accordingly from the second fluid chamber 70', 80 and 82' of the valve lifter so that the plunger 50' and the piston 64' are axially moved as a single unit toward the second internal piston 76. The axial displacement of the plunger 50' and the piston 64' being thus moved together causes a gradual increases in the second fluid chamber 70', 80 and 82' and also in the fluid pressure in the third fluid chamber 94. The push rod drive plunger 86 is now initiated into motion to drive the push rod 24 and thereby actuate the intake or exhaust valve of the power cylinder to open, as previously described in connection with the embodiment of FIGS. 3 to 5**.

After the cam 20 on the camshaft 22 is turned into the angular position having its protruded or high cam lobe portion contacted by the cam follower plunger 50' and as a consequence the plunger 50' has reached the second limit axial position thereof, the plunger 50' is axially moved back toward the first limit axial position thereof and causes reduction of the fluid pressure in the second fluid chamber 70', 80 and 82' and also in the third fluid chamber 94. The push-rod drive plunger 86 is now axially moved back to retract through the axial bore 46 in the plug member 36 and, at the same time, the second internal piston 76 is moved toward the axial position having the outer rim portion of its end wall 78 seated on the annular internal end face 42 of the lifter cylinder body 34 by the force of the spring 88 in the manners previously described with reference to FIGS. 3 to 5. Until the cam follower plunger 50' being thus moved through the elongated axial bore portion 38 in the lifter cylinder body 34 away from the second limit axial position reaches an axial position allowing the radial holes 72' in the first internal position 64' to be open to the first fluid chamber 68', the plunger 50' and the piston 64' are axially moved as a single unit so that the fluid pressure in the second fluid chamber 70', 80 and 82' and accordingly the fluid pressure in the third fluid chamber 94 decrease rapidly as the plunger 50' is moved toward the first limit axial position thereof. After the fluid pressure acting on the first internal piston 64' from the second fluid chamber 70', 80 and 82' is overcome by the sum of the force of the compression spring 74' and the force resulting from the atmospheric pressure acting on the outer end face of the piston 64', the piston 64' is caused to move relative to the cam follower plunger 50' toward the open inner axial end of the plunger 50' and, thus, reaches the previously mentioned equilibrium axial position thereof which is dictated by the fluid pressure developed in the second fluid chamber 70', 80 and 82'.

With the second preferred embodiment of the present invention thus constructed and operative, the timings at which the intake and exhaust valve actuated by the valve lifter are to open and close the intake or exhaust port and the amount of lift of the intake or exhaust valve are determined by the axial positions which the cam follower plunger 50' and the first internal piston 64' assume relative to each other when the former is in the first limit axial position thereof and the latter is in the above mentioned equilibrium axial position thereof as in the embodiment of FIGS. 3 to 5. The higher or lower the fluid pressure in the second fluid chamber 70', 80 and 82', the remotor or closer, respectively, is the equilibrium axial position of the first internal piston 64' from or to the open inner axial end of the cam follower plunger 50' and, as a consequence, the earlier or later, respectively, will the radial holes 72' in the first internal piston 64' be closed by the plunger 50' when the plunger 50' is being moved from the first limit axial position toward the second limit axial position thereof. The earlier or later the timings at which the radial holes 72' in the first internal piston 64' are thus closed by the plunger 50', the earlier or later, respectively, are the timings at which the intake or exhaust valve is to be actuated to open the intake or exhaust port and the larger or smaller, respectively, will the amount of lift of the intake or exhaust valve be.

When there is substantially no fluid pressure developed in the engine oil gallery 30 as during idling of the engine, the fluid pressure in the second fluid chamber 70', 80 and 82' of the valve lifter shown in FIGS. 6 to 8 will be reduced to a minimum. Under these conditions, the fluid pressure acting on the first internal piston 64' is overcome by the sum of the force of the compression spring 74' and the force resulting from the atmospheric pressure acting on the closed outer end face of the piston when the cam follower plunger 50' is held in the first limit axial position thereof. The piston 64' is therefore axially moved relative to the cam follower plunger 50' toward the open inner axial end of the plunger 50' and is brought into engagement at the outer peripheral edge of its annular flange portion 78' against the snap ring 114 on the inner peripheral wall of the inner axial end portion of the plunger 50' by the force of the spring 74' and the atmospheric pressure. The intake or exhaust valve actuated by the valve lifter in the absence of fluid pressure in the engine oil gallery 30 therefore undergoes the amount of valve lift which is determined by the distance between the annular internal end face 62' of the cam follower plunger 50' in the first limit axial position thereof and the farthest ends of the radial holes 72' in the stem portion of the first internal piston 64' thus engaged by the snap ring 114. The snap ring 114 is in this fashion effective to secure a minimum amount of valve lift of the intake or exhaust valve during, for example, idling condition of the engine.

From the foregoing description it will have been appreciated that the hydraulic valve lifter proposed by the present invention provides the following advantages:

(1) The opening and closing timings of the intake or exhaust valve actuated by the valve lifter and the amount of lift of the valve and accordingly the amount of overlap between the intake and exhaust valves can be properly varied with the fluid pressure being supplied to the valve lifter.

(2) Since the movement of the cam follower plunger 50 or 50' driven by the cam 20 can be transmitted to the push-rod drive plunger 86 without intervention of any axially abutting engagement between the movable members intervening between the two plungers, no mechanical impact occurs in the valve lifter and the intake or exhaust valve connected to the valve lifter through the push rod 24 can be operated smoothly and silently.

(3) By the formation of a layer of fluid between the annular internal end face 42 of the lifter cylinder body 34 and the outer rim portion of the end wall 78 of the second internal piston 76 when the rim portion is about to be seated on the annular internal end face 42, the piston 76 can be softly brought into contact with the end face 42 of the cylinder body 34 as a consequence the intake or exhaust valve operated by means of the push-rod drive plunger 86 responsive to the fluid pressure in the third fluid chamber 94 is enabled to smoothly close.

Figure 9:
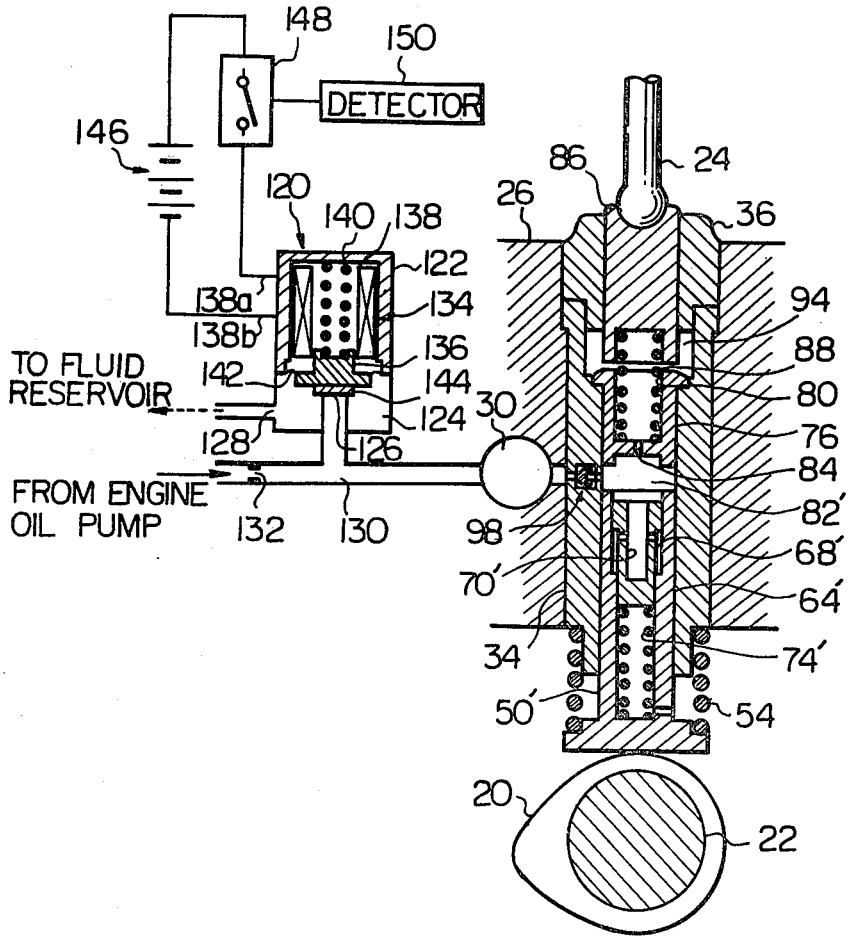
FIG. 9 is a sectional view showing, in part schematically, the arrangement in which a preferred embodiment of a fluid pressure control device which may also form part of a valve lift control apparatus according to the present invention is used in combination with a hydraulic valve lifter which is herein assumed, by way of example, to be essentially similar in construction to the hydraulic valve lifter illustrated in FIGS. 6 to 8.
Figure 10:
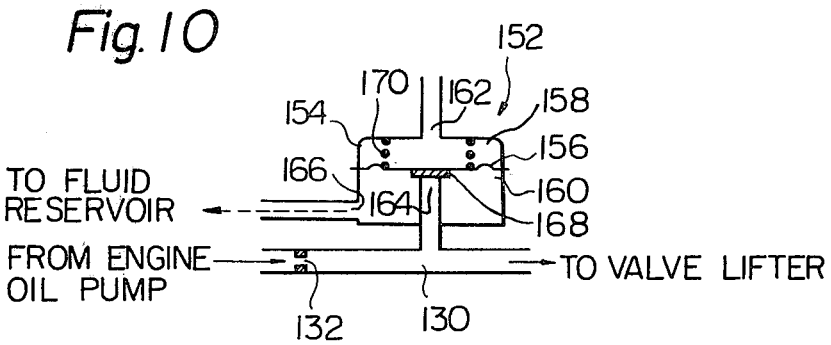
FIG. 10 is a schematic sectional view showing another preferred embodiment of the fluid pressure control device which may form part of a valve lift control apparatus according to the present invention.
Figure 11:
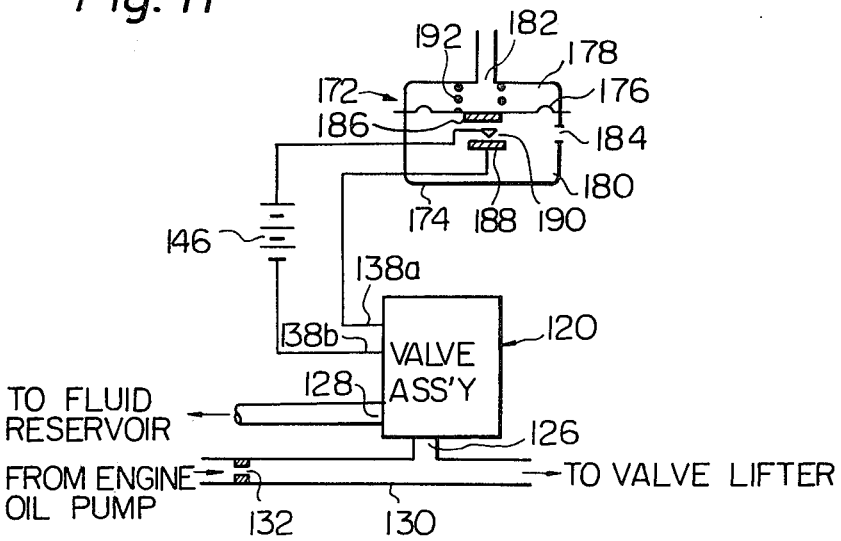
FIG. 11 is a schematic view showing, partly in section, a modification of the fluid pressure control device incorporated in the arrangement illustrated in FIG. 9.

While the hydraulic valve lifter having these advantages may be put to use without having recourse to any control over the fluid pressure to be supplied to the valve lifter, it is preferable that the valve lifter according to the present invention be used in combination with a fluid pressure control device also provided by the present invention to control the fluid pressure to be supplied to the valve lifter when the engine is operating cold or being warmed up during starting. FIGS. 9 to 11 show preferred embodiments of such a fluid control device.

In FIG. 9, the hydraulic valve lifter for use with a fluid pressure control device embodying the present invention is shown to the essentially similar in construction and arrangement to the valve lifter illustrated in FIGS. 6 to 8 of the drawings. It should however be borne in mind that the fluid pressure control device according to the present invention is compatible with the hydraulic valve lifter illustrated in FIGS. 3 to 5 or any of the known valve lifters of the hydraulically operated type.

Referring to FIG. 9, the fluid pressure control device embodying the present invention comprises an electromagnetically operated pressure relief valve assembly 120 having a casing 122 formed with a valve chamber 124, a fluid inlet port 126 projecting into the valve chamber 124 and a fluid outlet port 128 providing constant communication between the valve chamber 124 and a suitable fluid reservoir (not shown) such as the oil pan of the engine. The fluid inlet port 126 of the valve assmebly 120 is in constant communication with an engine oil passageway 130 leading from the lubricating oil pump (not shown) of the engine through an orifice 132 to the engine oil gallery 30 formed in the cylinder block 26 and communicating with the fluid chambers 68', 70', 80, 82' and 94 of the valve lifter through the oneway check valve 98.

The casing 122 of the valve assembly 120 has enclosed therein a solenoid unit 134 including a movable magnetic core or armature 136 and a stationary solenoid coil 138 helically would to form an axial bore having one end adjacent to the armature 136. The movable armature 136 is urged to axially move out of the bore in the solenoid coil 138 by suitable biasing means such as a preloaded helical compression return spring 140 which is shown positioned within the bore in the coil 138 and seated at one end on the inner face of one end wall of the casing 122 and at the other end thereof on the inner face of the armature 136. Thus, the solenoid unit 134 is arranged in such a manner that the movable armature 136 thereof is axially moved inwardly or outwardly with respect to the axial bore in the solenoid coil 138 when the solenoid coil 138 is energized and de-energized, respectively. The movable armature 136 of the solenoid unit 134 thus arranged is secured along its outer edge to a flexible diaphragm element 142 retained along its outer end to the casing 122, thereby defining the valve chamber 124 between the other end wall of the casing 122 and the movable armature 136. The movable armature 136 projects into the valve chamber 124 toward the fluid inlet port 126 and has securely mounted on its face adjacent to the fluid inlet port 126 a valve element 144 which is axially movable together with the armature 136 into and out of an axial position closing the fluid inlet port 126.

The coil 138 of the solenoid unit 134 has two terminals **138*a* and 138*b* which are connected together through a d.c. power source 146 and across a suitable switching circuit 148. The switching circuit 148 has a control terminal connected to a suitable detecting unit 150 which is adapted to deliver an output in response to any conditions indicating that an internal combustion engine is being cranked for starting or being warmed up after starting. Such a detecting unit 150 may be an oil temperature sensor responsive to variation in the temperature of engine lubricating oil, a water temperature sensor responsive to variation in the temperature of engine cooling water in an internal combustion engine of the water cooled type, or a choke-valve position detector responsive to a condition in which the choke valve provided in an internal combustion engine is in operation. As an alternative, the detecting unit 150 may be a time-limit switch or any other timing device electrically connected across or otherwise operatively associated with the ignition switch of an internal combustion engine and adapted to produce an electrical or mechanical output signal at a predetermined time interval after the ignition switch is closed for starting the engine. The switching circuit 148 connected to the detecting unit 150 of any of these types is operative to close when triggered by an output signal produced by the detecting device 150**.

In the absence of an output signal from the detecting unit 150 thus arranged, the switching circuit 148 remains open so that the coil 138 of the solenoid unit 134 forming part of the relief valve assembly 120 is maintained deenergized. The movable armature 136 of the solenoid unit 134 is therefore held by the force of the return spring 140 in the axial position having the fluid inlet port 126 of the valve assembly 120 closed by the valve element 144 attached to the armature 144 as shown in the drawing. The fluid inlet port 126 of the pressure relief valve assembly 120 being thus closed by the valve element 144, the fluid pressure delivered from the engine oil pump (not shown) is passed, without being modified, to the hydraulic valve lifter through the engine oil passageway 130 and the engine oil gallery 30 and past the one-way check valve 98 provided in the valve lifter.

When, however, the temperature of the lubricating oil or the cooling water of the engine is detected to be lower than a predetermined value prescribed on the detecting unit 150 or the choke valve of the engine is in a condition closing the air induction passageway of the engine or during a predetermined period of time after the ignition switch of the engine has been closed, the detecting unit 150 of any of the types above described delivers an output signal to the switching circuit 148 and thereby triggers the switching circuit 148 to close. A d.c. current is now supplied from the power source 146 to the coil 138 of the solenoid unit 134 through the switching circuit 148 and the terminals 138*a* and 138*b* of the coil, causing the movable armature 136 of the solenoid unit 134 to axially move against the force of the return spring 140 out of the position closing the fluid inlet port 126 of the pressure relief valve assembly 120 by the valve element 144 on the armature 136. The fluid inlet port 126 is now allowed to be open to the valve chamber 124 and accordingly to communicate with the fluid outlet port 128 of the valve assembly 120 so that the fluid supplied from the engine oil pump through the passageway 130 is partially discharged to the fluid reservoir (not shown) by way of the fluid inlet port 126, valve chamber 124 and fluid outlet port 128 of the valve assembly 120. The engine oil pump pressure which tends to rise to unusually high levels when the engine is operating cold is, thus, fed upon reduction by the pressure relief valve assembly 120 to the hydraulic valve lifter and enables the valve lifter to produce proper amounts of valve lift and overlap for the intake or exhaust valve being actuated by the valve lifter.

In view of the fact that the throttle valve of an internal combustion engine is, when the engine is being cranked cold, usually open to a degree approximately equal to the degree of opening of the throttle valve in the idling position thereof, the detecting unit 150 incorporated in the embodiment of the pressure control device shown in FIG. 9 may be substituted by suitable detecting means adapted to detect an idling condition of an internal combustion engine and to produce an electrical or mechanical output signal during idling of the engine. The detecting means of this nature may be arranged to be responsive to the movement of the throttle valve of an internal combustion engine or the movement of the accelerator pedal coupled to the throttle or of any member interconnecting the accelerator pedal and the throttle. As an alternative the detecting means may be arranged to be responsive to variation in the vacuum to be developed in the intake manifold of an internal combustion engine or the carburetor for the engine since the venturi vacuum or the intake manifold occurs at exceptionally high levels under idling conditions and also under cold starting conditions of the engine, as is well known in the art. Because, furthermore, of the fact that an internal combustion engine operates at exceptionally low speeds under idling conditions, the detecting means responsive to the idling conditions may be of a nature responsive to the output speed of an internal combustion engine. Under idling conditions of an internal combustion engine, it is usually required that the amount and time duration of valve lift be reduced to minimum values. For this reason, reducing the fluid pressure to be supplied to the valve lifter is advantageous not only for cold starting conditions but for idling conditions of an internal combustion engine. If desired, the detecting means thus responsive to idling conditions of an internal combustion engine may be put to use in combination with the detecting unit 150 of any of the types previously described.

FIG. 10 shows another preferred embodiment of the fluid pressure control device according to the present invention. The embodiment herein shown comprises a vacuum-operated pressure relief valve assembly 152 comprising a valve casing 154 which is internally divided by a flexible diaphragm element 156 secured to the casing 154 into a variable-volume vacuum chamber 158 and a variable-volume valve chamber 160 which are hermetically isolated from each other by the diaphragm element 156. The valve casing 154 is further formed with a vacuum port 162 open to the vacuum chamber 158, a fluid inlet port 164 projecting into the valve chamber 160 through one end wall of the casing 154, and a fluid outlet port 166 providing constant communication from the valve chamber 160 to a suitable fluid reservoir (not shown) such as the oil pan of the engine. The fluid inlet port 164 of the valve assembly 152 is in constant communication with the engine oil pump (not shown) through an engine oil passageway 130 having an orifice 132 provided therein. The diaphragm element 156 has attached to its face forming the valve chamber 160 within the casing 154 a valve element 168 which is movable together with the diaphragm element 156 into and out of an axial position closing the fluid inlet port 164. The valve element 168 thus attached to the diaphragm 156 is urged to hold such an axial position by suitable biasing means which is shown consisting of a preloaded helical compression spring 170 positioned between the vacuum chamber 158 and which is seated at one end on the inner face of the other end wall of the casing 154 and at the other end thereof on that face of the diaphragm element 156 which forms the vacuum chamber 158 within the casing 154 as shown. The compression spring 170 is, thus, effective to urge the diaphragm element 156 to expand the vacuum chamber 158 and contract the valve chamber 160. Though not shown in FIG. 10, the engine oil passageway 130 branched to the fluid inlet port 164 of the pressure relief valve assembly 152 thus constructed and arranged leads to a hydraulic valve lifter in a suitable manner as, for example, in the arrangement illustrated in FIG. 9. On the other hand, the vacuum port 162 open to the vacuum chamber 158 of the valve assembly 152 is in communication with the intake manifold or any mixture induction passageway (not shown) between the throttle valve in the carburetor of the engine and the power cylinder incorporating the valve lifter. In consideration of the fact that the partial vacuum to be developed in the intake manifold of an ordinary internal combustion engine is usually of the order of 500 millimeters of mercury, the pressure acting area of the diaphragm element 156 and the spring constant of the compression spring 170 incorporated in the valve assembly 152 should preferably be selected so that the valve element 168 on the diaphragm element 156 to be acted upon by such a vacuum be moved to open the fluid inlet port 164 in response to a vacuum higher in absolute value than, say, about 450 millimeters of mercury. When the vacuum developed in the intake manifold of the engine is lower than such a value, the diaphragm element 156 is forced by the spring 170 to hold the valve element 168 in the axial position closing the fluid inlet port 164 of the valve assembly 152 so that the fluid delivered from the engine oil pump (not shown) is passed to the hydraulic valve lifter without being partially discharged through the pressure relief valve assembly 152.

When, however, the vacuum in the intake manifold of the internal combustion engine is higher than a predetermined value of, for example, 450 mm of Hg as under idling cold cranking conditions of the engine, the vacuum extends through the vacuum port 162 into the vacuum chamber 158 of the pressure relief valve assembly 152 and causes the diaphragm element 156 to move in a direction to contract the vacuum chamber 158 and expand the valve chamber 160 against the force of the spring 170 so that the valve element 168 on the diaphragm element 156 is moved out of the position closing the fluid inlet port 164. Communication is now provided between the fluid inlet and outlet ports 164 and 166 through the valve chamber 160 in the valve assembly 152 so that the fluid supplied from the engine oil pump through the passageway 130 is partially discharged to the fluid reservoir (not shown) by way of the fluid inlet port 164, valve chamber 160 and fluid outlet port 168 of the valve assembly 152. The engine oil pressure is therefore fed upon reduction by the pressure relief valve assembly 152 to the hydraulic valve lifter, which is accordingly enabled to produce proper amounts of valve lift and overlap for the intake or exhaust valve being actuated by the valve lifter. The amounts of valve lift and overlap are, thus, reduced during cold starting or warm-up of the engine under the control of the pressure relief valve assembly 152. The reduction in the amounts of valve lift and overlap thus effected by the pressure relief valve assembly 152 takes place not only under cold starting or warm-up conditions of the engine but under idling conditions of the engine and during deceleration of the vehicle. Under decelerating conditions of a vehicle, however, the engine is subjected to practically no or relatively small amounts of load and, for this reason, the reduction in the amount of valve overlap caused under such conditions will take practically no effect on the performance efficiency of the engine.

FIG. 11 shows a modification of the pressure control device illustrated in FIG. 9. In the embodiment shown in FIG. 11, the switching circuit 148 included in the arrangement of FIG. 9 is replaced by a vacuum-operated switch unit 172 which is arranged to be responsive to the vacuum to be developed in the venturi of the carburetor of an internal combustion engine of the type using a carburetor as the fuel-air mixture supply system. The vacuum-operated switch unit 172 comprises a casing 174 internally divided by a flexible diaphragm element 176 secured to the casing 174 into a variable-volume vacuum chamber 178 and a variable-volume atmospheric chamber 180 which are hermetically separated from each other by the diaphragm element 156. The casing 174 of the switch unit 172 is further formed with a vacuum port 182 open to the vacuum chamber 178 and constantly communicating through suitable passageway means to the venturi of the carburetor (not shown) of the engine, and a breather port or vent 184 open to the atmospheric chamber 180 and to the atmosphere. The diaphragm element 176 has securely attached to its face forming the atmospheric chamber 180 within the casing 174 a switch actuating element 186 for actuating a set of stationary and movable contact elements 188 and 190 provided within the atmospheric chamber 180. The stationary contact element 188 is fixedly positioned within the atmospheric chamber 180 in front of the switch actuating element 186 on the diaphragm element 176 while the movable contact element 190 is positioned between the actuating element 186 and the stationary contact element 188 and is movable into and out of contact with the stationary contact element 188. The stationary and movable contact elements 188 and 190 thus arranged within the atmospheric chamber 180 of the switch unit 172 are electrically connected through a suitable d.c. power source 146 to the terminals **138*a* and 138*b* of an electromagnetically operated pressure relief valve assembly 120 constructed and arranged similarly to its counterpart in the embodiment illustrated in FIG. 9. The actuating element 186 on the diaphragm element 176 of the switch unit 172 is engageable with the movable contact element 190 and is movable, together with the diaphragm element 176 into and out of an axial position causing the movable contact element 190 to contact the stationary contact element 188. The actuating element 186 is urged to move toward such an axial position by suitable biasing means such as a preloaded helical compression return spring 192 which is positioned within the vacuum chamber 178 and which is seated at one end on the diaphragm element 176 and at the other end thereof on a wall portion of the casing 174 forming the vacuum chamber 178. The pressure acting area of the diaphragm element 176 and the spring constant of the return spring 192 are selected so that the force of the spring 192 is overcome by the force exerted on the diaphragm element 176 by a vacuum developed in the vacuum chamber 178 when the vacuum is lower than a predetermined value which is slightly lower than the atmospheric pressure developed in the atmospheric chamber 180**.

When, thus, the vacuum developed in the venturi of the carburetor of the engine is higher in absolute value than such a predetermined value, the diaphragm element 176 of the switch unit 172 thus constructed and arranged is forced to hold a condition contracting the vacuum chamber 178 against the force of the return spring 192 by the vacuum thus developed in the vacuum chamber 178 and holds the switch actuating element 186 disengaged from the movable contact element 190. The movable contact element 190 is therefore half spaced apart from the stationary contact element 188 by the above mentioned biasing means so that the coil forming part of the solenoid unit forming part of the valve assembly 120 is kept disconnected from the power source 146 and, as a consequence, the valve element included in the spaced apart from the stationary contact element 188 by suitable biasing means (not shown). Valve assembly 120 is maintained in a position blocking communication between the fluid inlet and outlet ports 126 and 128 of the valve assembly 120. The fluid delivered from the engine oil pump (not shown) is thus passed, without being modified, through the engine oil passageway 130 to the hydraulic valve lifter (not shown) communicating with the passageway 130.

When, however, the vacuum in the venturi of the carburetor is lower than the above mentioned predetermined value and is close to the atmospheric pressure as under cold starting or idling conditions of the engine, the diaphragm element 176 of the switch unit 172 is allowed to move into a condition expanding the vacuum chamber 178 by the force of the return spring 192 so that the switch actuating element 186 on the diaphragm element 176 is moved into the axial position pressing the movable contact 190 against the stationary contact element 188. The coil in the solenoid unit in the pressure relief valve assembly 120 is now electrically connected to the power source 146 through the contact elements 188 and 190 of the switch unit 172 and causes the valve element of the valve assembly 120 to provide communication between the fluid inlet and outlet ports 126 and 128 of the valve assembly. The fluid supplied from the engine oil pump through the passageway 130 is partially discharged to the oil reservoir (not shown) by way of the fluid inlet and outlet ports 126 and 128 of the valve assembly 120. The amounts of valve lift and overlap are in this fashion reduced under cold starting or warm-up conditions of the engine under the control of the vacuum operated switch unit 172. The reduction in the amounts of valve thus effected by the pressure relief valve assembly 120 takes place not only under these conditions but during idling of the engine. Under idling conditions of an internal combustion engine, however, the engine usually undergoes relatively small amounts of load and operates at relatively low speeds and, for these reasons, the reduction in the amount of valve overlap caused under such conditions of the engine will take practically no effect on the performance efficiency of the engine.

While it has been assumed that the hydraulic valve lifter according to the present invention and the hydraulic valve lifter for which the fluid pressure control device proposed by the present invention is to operate are incorporated into internal combustion engine of the push-rod type, such is not limitative of the scope of the present invention and, thus, it will be apparent that the subject matters of the present invention can be realized not only in internal combustion engines of the push-rod type but in internal combustion engines of the overhead camshaft type. In this instance, the push-rod drive plunger 86 forming part of each of the embodiments of the hydraulic valve lifter hereinbefore described and shown in FIGS. 3 to 8 of the drawings may be substituted by any member constructed and arranged essentially similarly to the plunger but which is designed to be directly connected to or engaged by the rocker arm for intake or exhaust valve for which the valve lifter is to operate. While, furthermore, the fluid pressure utilized in each of the embodiments of the hydraulic valve lifter according to the present invention has been assumed to the pressure of the engine lubricating oil to be supplied from the engine oil pump and to vary with the output speed of the engine, this is merely by way of example and, if desired, the hydraulic valve lifter according to the present invention may be arranged to operate on any fluid pressure variable with operational conditions of an internal combustion engine.

What is claimed is:

1. A valve lift control apparatus for an internal combustion engine, comprising a source of fluid pressure variable with operating conditions of the engine and a hydraulic valve lifter which comprises:

a hollow, axially elongated stationary lifter cylinder structure;

a first plunger axially slideable in the lifter cylinder structure and projecting axially outwardly from one axial end of the lifter cylinder structure;

a second plunger axially slideable in the lifter cylinder structure substantially in line with the first plunger and projecting axially outward from the other axial end of the lifter cylinder structure;

a first piston axially movable between the first and second plungers and forming between the first plunger and the first piston a first fluid chamber continuously variable in volume depending upon the axial positions which the first plunger and the first piston assume relative to each other;

a second piston axially movable between the first piston and the second plunger and forming at least in part between the first and second pistons a second fluid chamber continuously variable in volume depending upon the axial positions which the first and second pistons assume relative to each other; and passageway means for providing communication between said source of fluid pressure and said second fluid chamber;

the first piston being formed with a hole which is communicable with said first fluid chamber depending upon the axial positions of the first plunger and the first piston relative to each other and which is in constant communication with said second fluid chamber;

the second plunger and the second piston having formed at least in part therebetween a third fluid chamber continuously variable in volume depending upon the axial positions which the second plunger and the second piston assume relative to each other;

the second piston being formed with an orifice providing constant communication between the second and third fluid chambers therethrough;

means for obstructing and re-establishing communication between said hole in said first piston and said first fluid chamber in such a manner that the valve lift and the valve timing of the valve are determined by the timings at which the communication between said hole in said first piston and said first fluid chamber are to be obstructed and re-established by said first plunger, said obstructing and re-establishing means including said first plunger.

2. A valve lift control apparatus for an internal combustion engine, comprising a source of fluid pressure variable with operating conditions of the engine and a hydraulic valve lifter which comprises:

a hollow, axially elongated stationary lifter cylinder structure;

a first plunger axially slideable in the lifter cylinder structure and projecting axially outwardly from one axial end of the lifter cylinder structure;

a second plunger axially slideable in the lifter cylinder structure substantially in line with the first plunger and projecting axially outward from the other axial end of the lifter cylinder structure;

a first piston axially movable between the first and second plungers and forming between the first plunger and the first piston a first fluid chamber continuously variable in volume depending upon the axial positions which the first plunger and the first piston assume relative to each other;

a second piston axially movable between the first piston and the second plunger and forming at least in part between the first and second pistons a second fluid chamber continuously variable in volume depending upon the axial positions which the first and second pistons assume relative to each other; and passageway means for providing communication between said source of fluid pressure and said second fluid chamber;

the first piston being formed with a hole which is communicable with said first fluid chamber depending upon the axial positions of the first plunger and the first piston relative to each other and which is in constant communication with said second fluid chamber;

the second plunger and the second piston having formed at least in part therebetween a third fluid chamber continuously variable in volume depending upon the axial positions which the second plunger and the second piston assume relative to each other;

the second piston being formed with an orifice providing constant communication between the second and third fluid chambers therethrough;

said first plunger being operative to obstruct and re-establish communication between said hole in said first piston and said first fluid chamber in such a manner that the valve lift and the valve timing of the valve are determined by the timings at which the communication between said hole in said first piston and said first fluid chamber are to be obstructed and re-established by said first plunger.

3. A valve lift control apparatus as set forth in claim 2, in which said lifter cylinder structure has an internal surface portion engageable with said second piston in axial direction of the cylinder structure for limiting the axial movement of the second piston toward said first piston and away from said second plunger, said surface portion being exposed to the third fluid chamber when the second piston is disengaged therefrom.

4. A valve lift control apparatus as set forth in claim 2 or 3, further comprising displacement limiting means fast on one of said first plunger and the first piston for limiting the axial displacement of the first piston relative to the first plunger toward said second piston.

5. A valve lift control apparatus as set forth in claim 2 or 3, further comprising check valve means for providing oneway fluid communication from said source of fluid pressure to said second fluid chamber.

6. A valve lift control apparatus as set forth in claim 2 or 3, further comprising suction compensating means including a member movable at least in part into said first fluid chamber in response to a suction developed therein and out of the first fluid chamber in response to a fluid pressure developed therein.

7. A valve lift control apparatus as set forth in claim 2 or 3, further comprising first biasing means urging said first plunger to axially move away from said second plunger, second biasing means urging the first plunger and the first piston to axially outwardly move relative to each other, and third biasing means urging said second plunger and said second piston to axially move away from each other.

8. A valve lift control apparatus as set forth in claim 2 or 3, further comprising passageway means for providing fluid communication between the source of fluid pressure and the valve lifter, and a fluid pressure control device comprising detecting means for detecting predetermined operating conditions of the engine and delivering a signal representative of the detected operating conditions, the predetermined operating conditions including cold starting conditions of the engine, and a pressure relief valve assembly having a fluid inlet port communicating with said passageway means and a fluid outlet port communicable with the fluid inlet port, the valve assembly including a valve element movable into and out of a position isolating the fluid inlet and outlet ports from each other, the valve element being operative to be moved out of the position thereof for providing communication between the fluid inlet and outlet ports in the presence of the signal from the aforesaid detecting means.

9. A valve lift control apparatus as set forth in claim 8, in which said valve assembly further includes a casing formed with said fluid inlet and outlet ports, a flexible diaphragm element defining in said casing a variable-volume chamber and a variable-volume valve chamber said fluid inlet port projecting into said valve chamber and said fluid outlet port being constantly open to the valve chamber, passageway means for providing communication between said vacuum chamber and the mixture induction passageway in the engine, and biasing means for urging said diaphragm element to move in a direction to expand said vacuum chamber and move said valve element into said position thereof.

10. A valve lift control apparatus as set forth in claim 8, in which said source of fluid pressure is operative to deliver fluid pressure variable with the output speed of the engine.

11. A valve lift control apparatus as set forth in claim 10, in which said source of fluid pressure is constituted by a lubricating oil pump for the engine.

12. A valve lift control apparatus as set forth in claim 2, in which said lifter cylinder structure is formed with axial bore portions arranged substantially in line with each other and consisting of a first axial bore portion having one end at said one axial end of the cylinder structure, a second axial bore portion which has one end adjacent the other end of the first axial bore portion and which forms part of said second fluid chamber, and a third axial bore portion which has one end adjacent the other end of the second axial bore portion and the other end at said other end of the cylinder structure and which at least in part forms said third fluid chamber, said first plunger being in part axially slidable through said first axial bore portion and having an inner axial end in the first axial bore portion, said second piston being in part axially slidable through said first bore portion and in part axially movable within said second axial bore portion, and said second plunger being in part axially movable within said second axial bore portion and in part axially slidable through said third axial bore portion.

13. A valve lift control apparatus as set forth in claim 12, in which said lifter cylinder structure has at said one axial end of said second axial bore portion an internal end face engageable with said second piston in axial direction of the cylinder structure for limiting the axial movement of the second piston toward said first piston and away from said second plunger.

14. A valve lift control apparatus as set forth in claim 13, in which said second axial bore portion is larger in cross sectional area than said first axial bore position and in which said internal end face surrounds said other end of the first bore portion.

15. A valve lift control apparatus as set forth in claim 14, in which said second piston has a laterally enlarged axial end portion axially movable within said second axial bore portion and having said orifice formed therein, said axial end portion of the second piston being engageable with said internal end face for limiting the axial movement of the second piston away from said second plunger.

16. A valve lift control apparatus as set forth in any one of claims 12 to 15, further comprising biasing means provided between said second plunger and said second piston for urging the second plunger and the second piston to axially move away from each other.

17. A valve lift control apparatus as set forth in claim 18, in which said lifter cylinder structure is formed with a hole contiguous at one end thereof to said first fluid chamber and in which a free piston movable through said hole in the cylinder structure partially into said first fluid chamber in response to a suction developed therein and out of the first fluid chamber in response to a fluid pressure developed therein.

18. A valve lift control apparatus as set forth in any one of claims 12 to 15, in which said first plunger is formed with an axial bore having one end at said inner axial end thereof and in which said first piston has a stem portion axially slidable through the bore in the first plunger and a laterally enlarged axial end portion projecting from said stem portion into said first axial bore portion in said lifter cylinder structure and axially slidable through the first axial bore portion, said first fluid chamber being formed around part of said stem portion and axially between said inner axial end of the first plunger and said end portion of the first piston.

19. A valve lift control apparatus as set forth in claim 18, in which said first piston is formed with an axial bore open at one end toward said second piston and closed at the other end thereof, said axial bore in the first piston forming part of said second fluid chamber, said hole being formed in said stem portion of the first piston and being open to said axial bore in the first piston constantly and to said first fluid chamber laterally of the stem portion depending upon the axial positions which the first plunger and the first piston assume relative to each other.

20. A valve lift control apparatus as set forth in claim 19, further comprising biasing means urging said first plunger and said first piston to axially outwardly move relative to each other.

21. A valve lift control apparatus as set forth in claim 19, further comprising biasing means urging said first plunger to axially move away from said second plunger.

22. A valve lift control apparaus as set forth in any one of claims 12 to 15, in which said first plunger is formed with axial bore portions arranged substantially in line with each other and including a first axial bore portion open at said inner axial end of the first plunger and a second axial bore portion extending axially outwardly away from said first bore portion in the first plunger and smaller in cross sectional area than said first axial bore portion in the first plunger, said first piston having a stem portion which is in part axially slideable through the first axial bore portion in the first plunger and in part axially movable in the first axial bore portion in the lifter cylinder structure and a laterally enlarged axial end portion projecting from said stem portion into said first axial bore portion in the lifter cylinder structure and axially slideable through the first axial bore portion in the lifter cylinder structure, said first fluid chamber being formed around part of said stem portion and in part formed by part of the first axial bore portion in the lifter cylinder structure, said first axial bore portion in the lifter cylinder structure in part forming part of said second fluid chamber.

23. A valve lift control apparatus as set forth in claim 22, in which said first piston is formed with an axial bore open at one end in said first axial bore portion in said lifter cylinder structure and closed at the other end thereof, said axial bore in the first piston forming part of said second fluid chamber, said hole being formed in said stem portion of the first piston and being open to said axial bore in the first piston constantly and to said first fluid chamber laterally of the stem portion depending upon the axial positions which the first plunger and the first piston assume relative to each other.

24. A valve lift control apparatus as set forth in claim 22, further comprising a displacement limiting element securely received on an inner peripheral surface of said first plunger and located adjacent to said inner axial end of the first plunger, said first piston being engageable at the end of said laterally enlarged end portion thereof with said displacement limiting element when the first piston is axially moved relative to the first plunger toward said inner axial end of the first plunger.

25. A valve lift control apparatus as set forth in claim 22, further comprising biasing means urging said first plunger and said first piston to axially outwardly move relative to each other.

26. A valve lift control apparatus as set forth in claim 22, further comprising biasing means urging said first plunger to axially move away from said second plunger.

27. A valve lift control apparatus as set forth in claim 26, further comprising switch means electrically connected between said detecting means and said valve assembly for actuating said valve element to move out of said position thereof in response to a signal from the detecting means.

28. A valve lift control apparatus as set forth in claim 27, in which said valve assembly further includes a solenoid unit including a movable armature movable with said valve element and a solenoid coil electrically connected to a power source across said switch means.

29. A valve lift control apparatus as set forth in claim 27, in which said switch means comprises a vacuum-operated switch unit comprising a casing, a flexible diaphragm element secured to the casing and forming a variable-volume vacuum chamber in the casing, passageway means for providing communication between said vacuum chamber and the venturi of the engine, a switch actuating element attached to one face of said diaphragm element, a stationary contact element fast on said casing and spaced apart from said diaphragm element, a movable contact element positioned between said switch actuating element and said stationary contact element and movable into and out of contact with the stationary contact element, said actuating element being engageable with said movable contact element for moving the movable contact element intc contact with the stationary contact element, and biasing means urging said diaphragm element to move in a direction to expand said vacuum chamber and move said actuating element into engagement with the movable contact, the switch actuating element being disengaged from said movable contact element against the force of said biasing means for allowing the movable contact element to be disconnected from the stationary contact element in the presence of a vacuum higher than a predetermined value in said vacuum chamber, said stationary contact element and said movable contact element being electrically connected to said valve assembly through a power source.

* * * * *